US008080130B2

(12) United States Patent
Harper et al.

(10) Patent No.: US 8,080,130 B2
(45) Date of Patent: Dec. 20, 2011

(54) HIGH BASIS WEIGHT TAD TOWEL PREPARED FROM COARSE FURNISH

(75) Inventors: Frank D. Harper, Neenah, WI (US); Mark L. Robinson, Kaukauna, WI (US); Hung Liang Chou, Neenah, WI (US); Steven R. Olson, Menasha, WI (US); Martin A. Hynnek, Appleton, WI (US); Gary L. Worry, Appleton, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 406 days.

(21) Appl. No.: 12/357,524

(22) Filed: Jan. 22, 2009

(65) Prior Publication Data

US 2009/0194244 A1 Aug. 6, 2009

Related U.S. Application Data

(60) Provisional application No. 61/025,549, filed on Feb. 1, 2008.

(51) Int. Cl.

| | |
|---|---|
| ***D21F 11/00*** | (2006.01) |
| ***D21F 5/18*** | (2006.01) |
| ***D21H 27/40*** | (2006.01) |
| ***B31F 1/12*** | (2006.01) |

(52) U.S. Cl. ..... 162/123; 162/111; 162/118; 162/129; 162/149; 162/164.3; 162/177; 162/179; 428/153; 428/172

(58) Field of Classification Search ..... 162/111–113, 162/123–133, 141, 147, 149, 158, 164.1, 162/164.3, 168.1, 177, 179; 428/153, 156, 428/174, 340

See application file for complete search history.

(56) References Cited

U.S. PATENT DOCUMENTS

| | | | | |
|---|---|---|---|---|
| 2,926,116 | A | 2/1960 | Keim | |
| 3,058,873 | A | 10/1962 | Keim et al. | |
| 3,301,746 | A | 1/1967 | Sanford et al. | |
| 3,434,918 | A | 3/1969 | Bernardin | |
| 3,755,220 | A | 8/1973 | Freimark et al. | |
| 3,772,076 | A | 11/1973 | Keim | |
| 3,812,000 | A | 5/1974 | Salvucci, Jr. et al. | |
| 3,819,470 | A | 6/1974 | Shaw et al. | |
| 3,821,068 | A | 6/1974 | Shaw | |
| 3,994,771 | A | 11/1976 | Morgan, Jr. et al. | |
| 4,204,054 | A | 5/1980 | Lesas et al. | |
| 4,300,981 | A | 11/1981 | Carstens | |
| 4,431,481 | A | 2/1984 | Drach et al. | |
| 4,440,597 | A | 4/1984 | Wells et al. | |
| 4,528,316 | A | 7/1985 | Soerens | |
| 4,533,437 | A | 8/1985 | Curran et al. | |
| 5,087,324 | A | 2/1992 | Awofeso et al. | |
| 5,320,710 | A | 6/1994 | Reeves et al. | |
| 5,338,807 | A | 8/1994 | Espy et al. | |
| 5,348,620 | A | 9/1994 | Hermans et al. | |
| 5,569,358 | A | 10/1996 | Cameron | |
| 5,591,305 | A | 1/1997 | Cameron | |
| D384,210 | S | 9/1997 | du Grosriez | |
| 5,961,782 | A | 10/1999 | Luu et al. | |
| 6,133,405 | A | 10/2000 | Allen | |
| 6,153,053 | A | 11/2000 | Harper et al. | |
| 6,207,011 | B1 | 3/2001 | Luu et al. | |
| 6,280,570 | B1 | 8/2001 | Harper et al. | |
| 6,287,422 | B1 | 9/2001 | Harper et al. | |
| 6,372,087 | B2 | 4/2002 | Harper et al. | |
| 6,419,790 | B1 | 7/2002 | Leege et al. | |
| 6,998,016 | B2 * | 2/2006 | Yeh et al. | 162/109 |
| 7,682,488 | B2 * | 3/2010 | Yeh et al. | 162/198 |
| 7,828,931 | B2 * | 11/2010 | Edwards et al. | 162/111 |
| 2003/0196772 | A1 * | 10/2003 | Awofeso et al. | 162/111 |
| 2005/0006040 | A1 | 1/2005 | Boettcher et al. | |
| 2009/0194244 | A1 * | 8/2009 | Harper et al. | 162/111 |
| 2010/0126682 | A1 * | 5/2010 | Murray et al. | 162/111 |
| 2010/0170647 | A1 * | 7/2010 | Edwards et al. | 162/111 |
| 2010/0186913 | A1 * | 7/2010 | Super et al. | 162/111 |
| 2010/0212850 | A1 * | 8/2010 | Sumnicht et al. | 162/111 |
| 2010/0224338 | A1 * | 9/2010 | Harper et al. | 162/132 |
| 2010/0282423 | A1 * | 11/2010 | Super et al. | 162/111 |
| 2011/0011545 | A1 * | 1/2011 | Edwards et al. | 162/111 |
| 2011/0155337 | A1 * | 6/2011 | Murray et al. | 162/111 |

FOREIGN PATENT DOCUMENTS

| | | | |
|---|---|---|---|
| EP | 0806520 | A1 | 11/1997 |
| EP | 2088237 | A1 * | 8/2009 |
| WO | 01/85109 | A1 | 11/2001 |

OTHER PUBLICATIONS

Extended European Search Report for Application No. 09001039.8 that issued Jul. 13, 2009.

* cited by examiner

*Primary Examiner* — Jose A Fortuna
(74) *Attorney, Agent, or Firm* — Laura L. Bozek

(57) ABSTRACT

Kitchen roll toweling having surprising softness, absorbency and bulk is formed from a furnish comprising long cellulosic fiber having: (i) average weight-weighted fiber length of at least 2.5 mm; coarseness at least 15.5 mg/100 mm; and a Canadian Standard freeness of at least 600 ml combined with (ii) short cellulosic fiber having an average weight-weighted fiber length of at most 1.9 mm having a Canadian Standard freeness of at least 500 ml in a weight ratio of short fiber to long fiber of at least 0.25 to 1.0 to form a nascent web having a consistency in the range from about 10% to about 35% which is rush transferred from one fabric to another at a speed differential of at least about 15%; and creping the web from a Yankee dryer while controlling the real crepe to at most 3% and thereafter converting the web to form a two ply product having a basis weight of at least 29 lb/rm and caliper of at least 220 mils/8 sheets.

65 Claims, 8 Drawing Sheets

PRODUCT ABSORBENCY AS A FUNCTION OF EMBOSS PRESSURE

HIGH BASIS WEIGHT TAD TOWEL PREPARED FROM COARSE FURNISH

CLAIM FOR PRIORITY

This non-provisional patent application is based upon U.S. Provisional Patent Application Ser. No. 61/025,549, entitled "High Basis Weight TAD Towel Prepared From Coarse Furnish", filed Feb. 1, 2008. The priority of U.S. Provisional Patent Application Ser. No. 61/025,549 is hereby claimed and the disclosure thereof incorporated by reference into this application.

TECHNICAL FIELD

Paper toweling pervades modern industrial civilizations, being found in almost all kitchens and all but the fanciest of away from home restrooms, its wide use largely attributable to its low cost and ability to rapidly absorb moisture. In most cases, paper toweling is used for a single event, drying the hands, wiping up a spill, cleaning a window—then disposed of. Accordingly, low cost is extremely important for almost all grades. As far as performance goes, absorbency and cross direction wet strength are considered quite important across the spectrum for almost all grades of toweling as absorbency is a measure of how well the toweling will perform its intended function while cross-direction wet strength is a key determinant of the ability of the towel to resist shredding in use. In the case of kitchen roll toweling and the highest grades of washroom toweling, tactile properties become very important. In particular, softness is quite important in these grades. Reconciling low cost and high cross direction wet strength is not particularly difficult, at least at moderate levels, due to the availability of low cost permanent wet strength resins; but reconciling low-cost, high absorbency and softness presents a considerable technical challenge. As absorbency and softness are roughly inversely related to strength, it is often quite difficult to obtain the right balance of attributes.

This invention relates to a high-end paper towel which is suitable for use as kitchen roll towel and can be made from a non-premium furnish without use of softeners achieving not only perceived softness which is comparable to toweling made from premium furnishes but also achieves consumer acceptance exceeding that of leading towels made from premium furnish.

BACKGROUND OF THE INVENTION

There are numerous methods described in the patent literature which are said to improve the attributes of absorbent paper products. Some back up their conclusions with experimental data; but many present unsubstantiated statements that may need to be taken cum grano salis. Accordingly, making sense of the hodgepodge of art is far more easily accomplished using hindsight, the following collection being assembled and the relevance of many only becoming apparent only after the invention in the application had been made.

U.S. Pat. No. 3,301,746 by Sanford and Sisson, incorporated herein by reference in its entirety, describes a papermaking scheme for enhancing product attributes usually referred to as through air drying or TAD which avoids overall web compression by forming a patterned array of densified regions in the X-Y plane of the sheet to enhance product strength.

U.S. Pat. No. 4,440,597 by Wells and Hensler, incorporated herein by reference in its entirety, describing a method for increasing the stretch of a paper web by operating the forming section of a paper machine faster than the through air dryer section of the paper machine as an improvement to the basic TAD process for improving the attributes of a through-air-dried sheet. As a result of the speed differential, the paper web is inundated into the through air dryer fabric leading to enhanced stretch and absorbency properties in the base sheet and resulting product. This technique is often referred to a fabric creping.

U.S. Pat. No. 3,812,000 by Salvucci and Yiannos incorporated herein by reference in its entirety, disclose a technique for producing a soft tissue by avoiding mechanical compression of an elastomeric containing furnish until the consistency of the web is at least 80% solids. U.S. Pat. No. 3,821,068 by Shaw, incorporated herein by reference in its entirety, discloses a papermaking scheme for producing soft tissue by avoiding mechanical compaction until the sheet has been dried to at least 80% solids.

U.S. Pat. No. 4,533,437 by Curran and Kershaw, incorporated herein by reference in its entirety; U.S. Pat. Nos. 5,591,305 and 5,569,358 by Cameron, all incorporated herein by reference in their entirety, disclose low-batting, high-bulk-generating felt with improved dewatering capabilities.

Fiber and chemicals can be used to modify the attributes of absorbent paper products. For example, U.S. Pat. No. 5,320,710 by Reeves et al., and incorporated herein by reference in its entirety, describes a new furnish combination extracted from the species *Funifera* of the genus *Hesporaloe* in the Agavaceae family. This furnish has fibers which are very long and which have very fine geometrical attributes known to enhance towel and tissue performance. U.S. Pat. No. 3,755,220 by Freimark and Schaftlein, incorporated herein by reference in its entirety, describes a debonding scheme for maintaining wet strength while reducing product dry strength—a method said to enhance the handfeel of towel products.

The use of bulking fibers is said to improve the attributes of the final end absorbent paper product. U.S. Pat. No. 3,434,918 by Bernardin, U.S. Pat. No. 4,204,054 by Lesas et al., U.S. Pat. No. 4,431,481 by Drach et al., U.S. Pat. No. 3,819,470 by Shaw et al., and U.S. Pat. No. 5,087,324 by Awofeso et al., disclose the use of bulking fibers in papermaking webs to improve product attributes like thickness, absorbency, and softness. The aforementioned patents are incorporated herein by reference in their entirety.

U.S. Pat. No. 5,348,620 by Hermans et al., and incorporated herein by reference, discusses a high consistency/high temperature fiber treatment-process using a disperser to improve absorbent paper product attributes. U.S. Pat. No. 4,300,981 by Carstens and U.S. Pat. No. 3,994,771 by Morgan et al., incorporated herein in their entirety by reference, discloses using certain species of hardwood like eucalyptus in stratified webs to improve tissue softness.

Even though the patent literature is replete with suggestions of methods said to improve attributes of towel and tissue products, R&D departments are in general unable to provide practical improvements in absorbent paper products merely by choosing one attribute from column A and another from column B as there are innumerable tradeoffs involved. For example, two-ply products are usually more absorbent and softer than comparable one-ply products. These products are usually formed with the Yankee side of each ply of the web facing outwardly, the Yankee side being typically far smoother than the air side of the web. In addition, bending stiffness of a two-ply product with a slip plane can be roughly one fourth that of similar thickness one-ply products without a slip plane. Since strength and basis weight are directly related while softness and strength are inversely related, increasing basis weight while preserving softness can be problematic. However, when basesheet is converted to finished product, there is typically a converting waste variously estimated at around 15% that must be accounted for in determining whether the advantage of two-ply construction is worth the cost, while it is generally understood that paper machines have higher productivity running heavier sheets such as those found in single ply products. Further, the technology used to emboss and marry the two plies can have quite detrimental effects on softness and strength. Further, while chemicals can be used to improve the tactile properties of the web, they often cause detrimental effects of magnitude not easily predicted unerringly in advance. Thus, manufacturers of absorbent paper products continue to spend millions each year to satisfy their continuing need to find new methods to improve these products. In particular there is a need to for improved methods to produce two-ply towel products combining absorbency, softness, thickness and strength attributes which will satisfy the needs of consumers at costs that are acceptable.

SUMMARY OF THE INVENTION

We have found that we can provide a low-cost, high-softness and absorbency toweling product by providing a multi-ply TAD cellulosic web having a basis weight of at least 32.0 lb/rm, wherein: the short fiber content of the web by weight is at least about 20% to 50%, preferably 30% to 45%, most preferably about 35 to 45%; the short fiber freeness is above 500 ml; the coarseness of the long fiber component is at least about 15.5 mg/100 m, the freeness of the long fiber component is above 600 ml; and the weight-weighted average fiber length of the total fiber in the web is above about 2.2 mm, preferably above about 2.3, more preferably 2.4, and most preferably above 2.5. We particularly prefer to use a fiber blend in which the ratio of coarseness, C, to weight-weighted average fiber length, $l_z$, is in excess of 5.3 finding that this helps us provide performance exceeding that of competitors using fiber blends having rather lower ratios of $C/l_z$ (i.e. <5.0). Even though lower values for $C/l_z$ are generally considered more desirable as leading to improved softness, we find that, even using this generally less desirable—and less expensive fiber blend, we can surpass the perceived softness of the market leading brand by using the claimed combinations of parameters.

During manufacture of the webs which are ultimately combined to form up the multi-ply product, we find that it is critical to maintain the fabric crepe levels of the two webs above 18% while the reel crepe level is kept to no more than about 3% and the crepe solids is kept to above 96%. When the plies are combined, they are joined by unusually heavy embossing such that the finished product caliper is above 225 mils/8 sheet (6.2 mils/8 sheets per lb/ream of fiber).

BRIEF DESCRIPTION OF THE DRAWINGS

FIGS. 3A and 3B are schematic illustrations of an emboss pattern suitable for toweling of the present invention wherein FIG. 3A is the obverse (outer side) side of the towel and FIG. 3B is the reverse.

DESCRIPTION OF PREFERRED EMBODIMENTS

Figure 1:
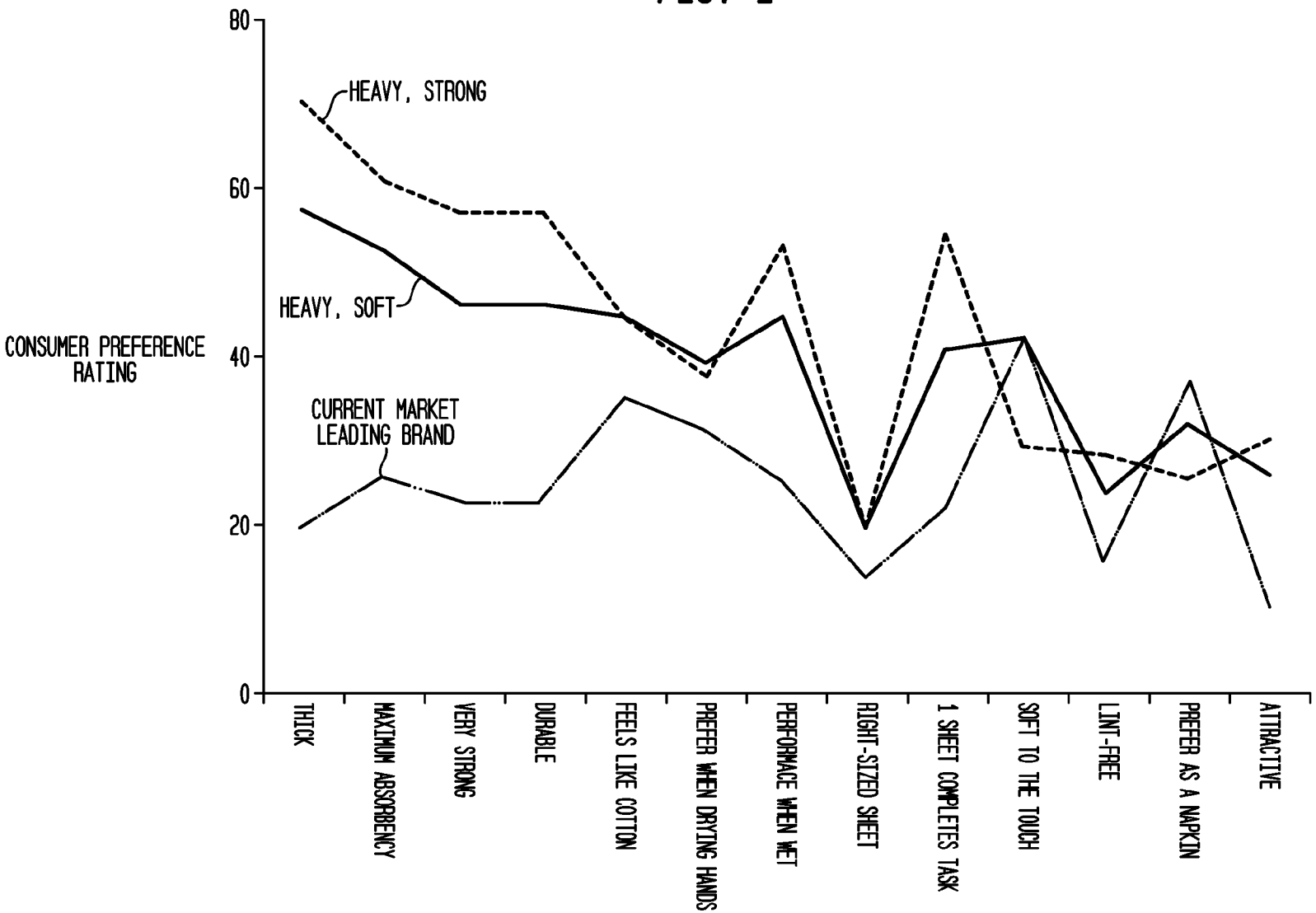
FIG. 1 is a graph illustrating consumer preference of two products of the present invention as compared to the current market leading brand in a home use test.

Toweling of the present invention is both extremely heavy and is perceived as extremely soft when compared to the best of currently available offerings, even though it can be manufactured from distinctly non-premium furnish using high levels of fabric crepe combined with low reel crepe. High levels of absorbency can be maintained as softeners are not required to achieve extreme softness. FIG. 1 illustrates the performance of two grades of toweling of the present invention (heavy, soft and heavy, strong) as compared to the current market leading brand designated "B" in home use testing by consumers against a wide variety of toweling. It is considered extremely significant that both embodiments far surpass the current market leading brand in almost every category.

Figure 2:
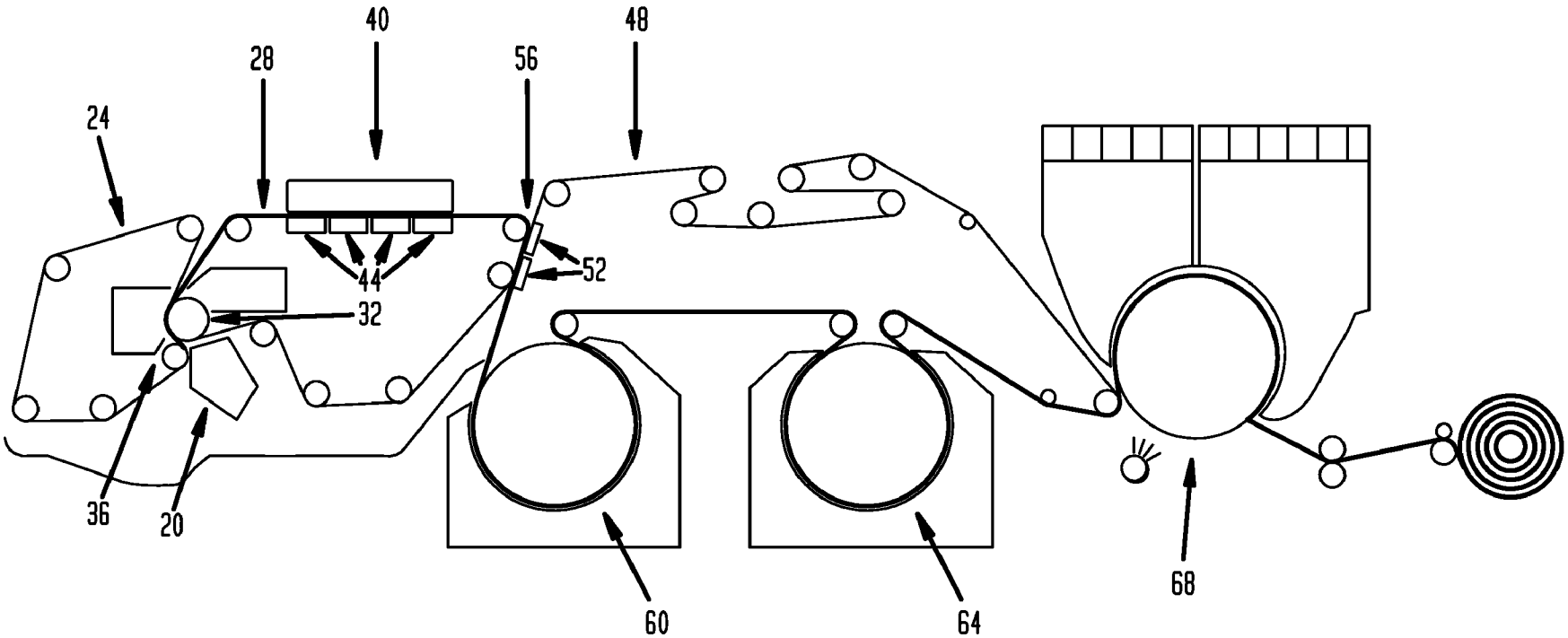
FIG. 2 is a schematic illustrating a paper machine suitable for producing basesheet for toweling of the present invention.

Toweling of the present invention can be produced on conventional through-air dried machines incorporating a twin wire former as shown in FIG. 2 in which furnish supplied through head box 20 is directed in a jet into the nip formed between forming fabric 24 and transfer fabric 28 as they pass between forming roll 32 and breast roll 36 as forming fabric 24 and transfer fabric 28 translate in continuous loops diverging after passing between forming roll 32 and breast roll 36. After separating from forming fabric 24, transfer fabric 28 passes through dewatering zone 40 in which suction boxes 44 remove moisture from the web and transfer fabric 28 increasing the consistency of the web to perhaps 10 to 25% prior to transfer of the web to through drying fabric 48. In some instances, it will be advantageous to apply some amount of vacuum as indicated through vacuum assist boxes 52 in the transfer zone 56 particularly when a considerable amount of fabric crepe is imparted to the web in transfer zone 56 by rush transfer, as in the present invention in which it is desired that at least about 18% fabric crepe is applied in transfer zone 56. As through-drying fabric 48 passes around through dryers 60 and 64, the consistency of the web is increased to perhaps 60 to 90%, at which point the open fabric creped structure more or less permanently imparted to the web can then be transferred to Yankee cylinder 68 without a major degradation of its properties by contacting the web with adhesive sprayed on to Yankee cylinder 68 just prior to contact with the translating web. After the web reaches a consistency of at least about 96%, only light creping is used to dislodge it from Yankee cylinder 68 while the reel speed is controlled relative to the speed of Yankee cylinder 68 such that, at most, about 3% reel crepe is applied to the web.

Surprisingly, low grade fiber may be used to produce toweling of the present invention, the furnish comprising about 20 to 50% by weight of short high freeness cellulosic fiber and up to about 80% of relatively coarse high freeness long fiber having a coarseness (C) of at least about 15.5 mg/100 m. The weight percent of short high freeness cellulosic fiber is preferably from about 30% to 45% and more preferably is about 35% to 45%. It is generally disadvantageous to apply more than light refining to either component of the furnish. The freeness (CSF) of the short fiber component should be at least 500 ml while the freeness of the long fiber component should be above 600 ml. Fiber lengths, and proportions should be controlled such that the weight weighted average fiber length ($l_z$) of the furnish is at least about 2.2 mm, preferably above 2.3, more preferably above about 2.4, and most preferably above 2.5, with the ratio of coarseness to weight weighted average fiber length ($C/l_z$) exceeding 5.3, in contrast to current market leading brands having lower $C/l_z$ values, typically under 5.0.

After the web is reeled, sheets are ply bonded together using the overall emboss pattern of U.S. Pat. No. D384,210 shown in FIGS. 3A and 3B wherein the embodiments set out are used for the opposing sides of the sheets to form nested concentric circles on alternating sides of the two ply web with the element height and penetration being chosen such that the finished product caliper is above 6.2 mils/8 sheets per lb/rm of basis weight. We prefer using a stratified headbox wherein layers enriched in long fiber content are disposed to the exterior of the finished product. Preferably the long fiber content of the layers forming the exterior of the product will comprise at least about 50%; more preferably at least about 70%; and most preferably about 80% by weight of long fiber.

The creping adhesive used on the Yankee cylinder is capable of cooperating with the web at intermediate moisture to facilitate transfer from the creping fabric to the Yankee and to firmly secure the web to the Yankee cylinder as it is dried to a consistency of 96% or more on the cylinder preferably with a high velocity drying hood. The adhesive is preferably a hygroscopic, re-wettable, substantially non-crosslinking adhesive. Examples of preferred adhesives include poly(vinyl alcohol) of the general class described in U.S. Pat. No. 4,528,316 to Soerens et al. Other suitable adhesives are disclosed in co-pending United States Published Patent Application 2005/0006040, Jan. 13, 2005, Boettcher, et al., Ser. No. 10/409,042 filed Apr. 9, 2003, entitled Improved Creping Adhesive Modifier and Process for Producing Paper Products. The disclosures of the '316 patent and the Boettcher, et al. application are incorporated herein by reference. Suitable adhesives are optionally provided with modifiers and so forth. It is preferred to use crosslinker sparingly or not at all in the adhesive so that in many cases the resin will be substantially non-crosslinked in use.

Creping adhesives may comprise and may comprise a thermosetting or non-thermosetting resin, a film-forming semi-crystalline polymer and optionally an inorganic cross-linking agent as well as modifiers. Optionally, the creping adhesive of the present invention may also include any art-recognized components, including, but not limited to, organic cross linkers, hydrocarbons oils, surfactants, or plasticizers.

Creping modifiers which may be used include a quaternary ammonium complex comprising at least one non-cyclic amide. The quaternary ammonium complex may also contain one or several nitrogen atoms (or other atoms) that are capable of reacting with alkylating or quaternizing agents. These alkylating or quaternizing agents may contain zero, one, two, three or four non-cyclic amide containing groups. An amide containing group is represented by the following formula structure:

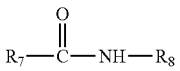

where $R_7$ and $R_8$ are non-cyclic molecular chains of organic or inorganic atoms. Preferred non-cyclic bis-amide quaternary ammonium complexes can be of the formula:

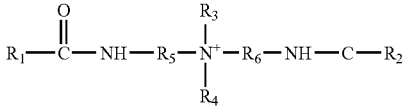

where $R_1$ and $R_2$ can be long chain non-cyclic saturated or unsaturated aliphatic groups; $R_3$ and $R_4$ can be long chain non-cyclic saturated or unsaturated aliphatic groups, a halogen, a hydroxide, an alkoxylated fatty acid, an alkoxylated fatty alcohol, a polyethylene oxide group, or an organic alcohol group; and $R_5$ and $R_6$ can be long chain non-cyclic saturated or unsaturated aliphatic groups. The modifier is present in the creping adhesive in an amount of from about 0.05% to about 50%, more preferably from about 0.25% to about 20%, and most preferably from about 1% to about 18% based on the total solids of the creping adhesive composition.

Modifiers include those obtainable from Goldschmidt Corporation of Essen, Germany, or Process Application Corporation based in Washington Crossing, Pa. Appropriate creping modifiers from Goldschmidt Corporation include, but are not limited to, VARISOFT® 222LM, VARISOFT® 222, VARISOFT® 110, VARISOFT® 222LT, VARISOFT® 110 DEG, and VARISOFT® 238. Appropriate creping modifiers from Process Application Corporation include, but are not limited to, PALSOFT 580 FDA or PALSOFT 580C.

Other creping modifiers for use in the present invention include, but are not limited to, those compounds as described in WO/01/85109, which is incorporated herein by reference in its entirety.

Creping adhesives for use according to the present invention include any art recognized thermosetting or non-thermosetting resin. Resins according to the present invention are preferably chosen from thermosetting and non-thermosetting polyamide resins or glyoxylated polyacrylamide resins. Polyamides for use in the present invention can be branched or unbranched, saturated or unsaturated.

Polyamide resins for use in the present invention may include polyaminoamide-epichlorohydrin (PAE) resins of the same general type employed as wet strength resins. PAE resins are described, for example, in "Wet-Strength Resins and Their Applications," Ch. 2, H. Espy entitled Alkaline-Curing Polymeric Amine-Epichlorohydrin Resins, which is incorporated herein by reference in its entirety. Preferred PAE resins for use according to the present invention include a water-soluble polymeric reaction product of an epihalohydrin, preferably epichlorohydrin, and a water-soluble polyamide having secondary amine groups derived from a polyalkylene polyamine and a saturated aliphatic dibasic carboxylic acid containing from about 3 to about 10 carbon atoms.

A non-exhaustive list of non-thermosetting cationic polyamide resins can be found in U.S. Pat. No. 5,338,807, issued to Espy et al. and incorporated herein by reference. The non-thermosetting resin may be synthesized by directly reacting the polyamides of a dicarboxylic acid and methyl bis(3-aminopropyl)amine in an aqueous solution, with epichlorohydrin. The carboxylic acids can include saturated and unsaturated dicarboxylic acids having from about 2 to 12 carbon atoms, including for example, oxalic, malonic, succinic, glutaric, adipic, pilemic, suberic, azelaic, sebacic, maleic, itaconic, phthalic, and terephthalic acids. Adipic and glutaric acids are preferred, with adipic acid being the most preferred. The esters of the aliphatic dicarboxylic acids and aromatic dicarboxylic acids, such as the phathalic acid, may be used, as well as combinations of such dicarboxylic acids or esters.

Thermosetting polyamide resins for use in the present invention may be made from the reaction product of an epihalohydrin resin and a polyamide containing secondary amine or tertiary amines. In the preparation of such a resin, a dibasic carboxylic acid is first reacted with the polyalkylene polyamine, optionally in aqueous solution, under conditions suitable to produce a water-soluble polyamide. The preparation of the resin is completed by reacting the water-soluble amide with an epihalohydrin, particularly epichlorohydrin, to form the water-soluble thermosetting resin.

The of preparation of water soluble, thermosetting polyamide-epihalohydrin resin is described in U.S. Pat. Nos. 2,926,116; 3,058,873; and 3,772,076 issued to Keim, all of which are incorporated herein by reference in their entirety.

The polyamide resin may be based on DETA instead of a generalized polyamine. Two examples of structures of such a polyamide resin are given below. Structure 1 shows two types of end groups: a di-acid and a mono-acid based group:

Note that although both structures are based on DETA, other polyamines may be used to form this polymer, including those, which may have tertiary amide side chains.

The polyamide resin has a viscosity of from about 80 to about 800 centipoise and a total solids of from about 5% to about 40%. The polyamide resin is present in the creping adhesive according to the present invention in an amount of from about 0% to about 99.5%. According to another embodiment, the polyamide resin is present in the creping adhesive in an amount of from about 20% to about 80%. In yet another embodiment, the polyamide resin is present in the creping adhesive in an amount of from about 40% to about 60% based on the total solids of the creping adhesive composition.

Polyamide resins for use according to the present invention can be obtained from Ondeo-Nalco Corporation, based in Naperville, Ill., and Hercules Corporation, based in Wilmington, Del. Creping adhesive resins for use according to the present invention from Ondeo-Nalco Corporation include, but are not limited to, CREPECCEL® 675NT, CREPECCEL® 675P and CREPECCEL® 690HA. Appropriate creping adhesive resins available from Hercules Corporation include, but are not limited to, HERCULES 82-176, Unisoft 805 and CREPETROL A-6115.

STRUCTURE 1

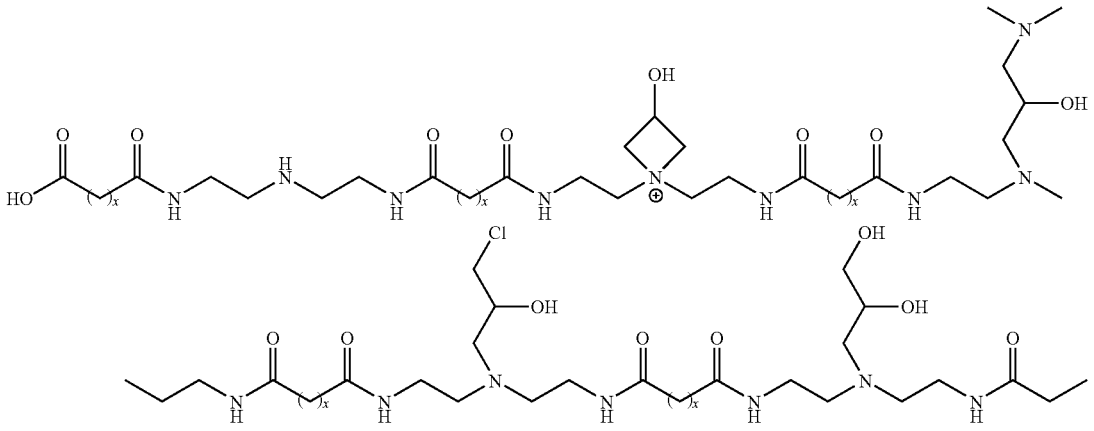

Structure 2 shows a polymer with one end-group based on a di-acid group and the other end-group based on a nitrogen group:

STRUCTURE 2

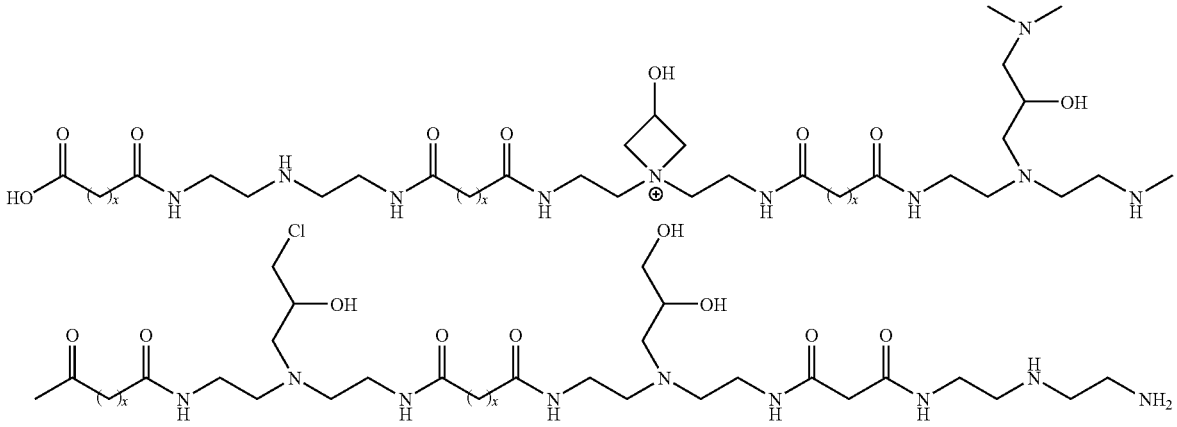

Other polyamide resins for use according to the present invention include, for example, those described in U.S. Pat. Nos. 5,961,782 and 6,133,405, both of which are incorporated herein by reference.

The creping adhesive may also comprise a film-forming semi-crystalline polymer. Film-forming semi-crystalline polymers for use in the present invention can be selected from, for example, hemicellulose, carboxymethyl cellulose, and most preferably includes polyvinyl alcohol (PVOH). Polyvinyl alcohols used in the creping adhesive can have an average molecular weight of about 13,000 to about 124,000 daltons. According to one embodiment, the polyvinyl alcohols have a degree of hydrolysis of from about 80% to about 99.9%. According to another embodiment, polyvinyl alcohols have a degree of hydrolysis of from about 85% to about 95%. In yet another embodiment, polyvinyl alcohols have a degree of hydrolysis of from about 86% to about 90%. Also, according to one embodiment, polyvinyl alcohols preferably have a viscosity, measured at 20 degree centigrade using a 4% aqueous solution, of from about 2 to about 100 centipoise. According to another embodiment, polyvinyl alcohols have a viscosity of from about 10 to about 70 centipoise. In yet another embodiment, polyvinyl alcohols have a viscosity of from about 20 to about 50 centipoise.

Typically, if polyvinyl alcohol is included, it is present in the creping adhesive in an amount of from about 10% to 90% or 20% to about 80%. In some embodiments, the polyvinyl alcohol is present in the creping adhesive in an amount of from about 40% to about 60%, by weight, based on the total solids of the creping adhesive composition.

Polyvinyl alcohols for use according to the present invention include those obtainable from Monsanto Chemical Co. and Celanese Chemical. Appropriate polyvinyl alcohols from Monsanto Chemical Co. include Gelvatols, including, but not limited to, GELVATOL 1-90, GELVATOL 3-60, GELVATOL 20-30, GELVATOL 1-30, GELVATOL 20-90, and GELVATOL 20-60. Regarding the Gelvatols, the first number indicates the percentage residual polyvinyl acetate and the next series of digits when multiplied by 1,000 gives the number corresponding to the average molecular weight.

Celanese Chemical polyvinyl alcohol products for use in the creping adhesive (previously named Airvol products from Air Products until October 2000) are listed below:

TABLE 1

Polyvinyl Alcohol for Creping Adhesive

| Grade | % Hydrolysis | Viscosity, cps[1] | pH | Volatiles, % Max. | Ash, % Max.[3] |
|---|---|---|---|---|---|
| Super Hydrolyzed | | | | | |
| Celvol 125 | 99.3+ | 28-32 | 5.5-7.5 | 5 | 1.2 |
| Celvol 165 | 99.3+ | 62-72 | 5.5-7.5 | 5 | 1.2 |
| Fully Hydrolyzed | | | | | |
| Celvol 103 | 98.0-98.8 | 3.5-4.5 | 5.0-7.0 | 5 | 1.2 |
| Celvol 305 | 98.0-98.8 | 4.5-5.5 | 5.0-7.0 | 5 | 1.2 |
| Celvol 107 | 98.0-98.8 | 5.5-6.6 | 5.0-7.0 | 5 | 1.2 |
| Celvol 310 | 98.0-98.8 | 9.0-11.0 | 5.0-7.0 | 5 | 1.2 |
| Celvol 325 | 98.0-98.8 | 28.0-32.0 | 5.0-7.0 | 5 | 1.2 |
| Celvol 350 | 98.0-98.8 | 62-72 | 5.0-7.0 | 5 | 1.2 |
| Intermediate Hydrolyzed | | | | | |
| Celvol 418 | 91.0-93.0 | 14.5-19.5 | 4.5-7.0 | 5 | 0.9 |
| Celvol 425 | 95.5-96.5 | 27-31 | 4.5-6.5 | 5 | 0.9 |
| Partially Hydrolyzed | | | | | |
| Celvol 502 | 87.0-89.0 | 3.0-3.7 | 4.5-6.5 | 5 | 0.9 |
| Celvol 203 | 87.0-89.0 | 3.5-4.5 | 4.5-6.5 | 5 | 0.9 |

TABLE 1-continued

Polyvinyl Alcohol for Creping Adhesive

| Grade | % Hydrolysis | Viscosity, cps[1] | pH | Volatiles, % Max. | Ash, % Max.[3] |
|---|---|---|---|---|---|
| Celvol 205 | 87.0-89.0 | 5.2-6.2 | 4.5-6.5 | 5 | 0.7 |
| Celvol 513 | 86.0-89.0 | 13-15 | 4.5-6.5 | 5 | 0.7 |
| Celvol 523 | 87.0-89.0 | 23-27 | 4.0-6.0 | 5 | 0.5 |
| Celvol 540 | 87.0-89.0 | 45-55 | 4.0-6.0 | 5 | 0.5 |

[1]4% aqueous solution, 20° C.

The creping adhesive may also comprise one or more inorganic cross-linking salts or agents. Such additives are believed best used sparingly or not at all in connection with the present invention. A non-exhaustive list of multivalent metal ions includes calcium, barium, titanium, chromium, manganese, iron, cobalt, nickel, zinc, molybdenium, tin, antimony, niobium, vanadium, tungsten, selenium, and zirconium. Mixtures of metal ions can be used. Preferred anions include acetate, formate, hydroxide, carbonate, chloride, bromide, iodide, sulfate, tartrate, and phosphate. An example of a preferred inorganic cross-linking salt is a zirconium salt. The zirconium salt for use according to one embodiment of the present invention can be chosen from one or more zirconium compounds having a valence of plus four, such as ammonium zirconium carbonate, zirconium acetylacetonate, zirconium acetate, zirconium carbonate, zirconium sulfate, zirconium phosphate, potassium zirconium carbonate, zirconium sodium phosphate, and sodium zirconium tartrate. Appropriate zirconium compounds include, for example, those described in U.S. Pat. No. 6,207,011, which is incorporated herein by reference.

The inorganic cross-linking salt can be present in the creping adhesive in an amount of from about 0% to about 30%. In another embodiment, the inorganic cross-linking agent can be present in the creping adhesive in an amount of from about 1% to about 20%. In yet another embodiment, the inorganic cross-linking salt can be present in the creping adhesive in an amount of from about 1% to about 10% by weight based on the total solids of the creping adhesive composition. Zirconium compounds for use according to the present invention include those obtainable from EKA Chemicals Co. (previously Hopton Industries) and Magnesium Elektron, Inc. Appropriate commercial zirconium compounds from EKA Chemicals Co. are AZCOTE 5800M and KZCOTE 5000 and from Magnesium Elektron, Inc. are AZC or KZC.

Optionally, the creping adhesive according to the present invention can include any other art recognized components, including, but not limited to, organic cross-linkers, hydrocarbon oils, surfactants, amphoterics, humectants, plasticizers, or other surface treatment agents. An extensive, but non-exhaustive, list of organic cross-linkers includes glyoxal, maleic anhydride, bismaleimide, bis acrylamide, and epihalohydrin. The organic cross-linkers can be cyclic or non-cyclic compounds. Plastizers for use in the present invention can include propylene glycol, diethylene glycol, triethylene glycol, dipropylene glycol, and glycerol.

The creping adhesive may be applied as a single composition or may be applied in its component parts. More particularly, the polyamide resin may be applied separately from the polyvinyl alcohol (PVOH) and the modifier.

Unless otherwise specified, "basis weight", BWT, bwt and so forth refers to the weight of a 3000 square foot ream of product in pounds. Likewise, percent or like terminology refers to weight percent on a dry basis, that is to say, with no free water present, which is equivalent to 5% moisture in the fiber. Throughout this specification and claims, it is to be understood that, unless otherwise specified, physical properties are measured after the web has been conditioned according to TAPPI standards. If no test method is explicitly set forth for measurement of any quantity mentioned herein, it is to be understood that TAPPI standards should be applied.

Absorbency of the inventive products is measured with a simple absorbency tester. The simple absorbency tester is a particularly useful apparatus for measuring the hydrophilicity and absorbency properties of a sample of tissue, napkins, or towel. In this test a sample of tissue, napkins, or towel 2.0 inches in diameter is mounted between a top flat plastic cover and a bottom grooved sample plate. The tissue, napkin, or towel sample disc is held in place by a ⅛ inch wide circumference flange area. The sample is not compressed by the holder. De-ionized water at 73° F. is introduced to the sample at the center of the bottom sample plate through a 1 mm. diameter conduit. This water is at a hydrostatic head of minus 5 mm. Flow is initiated by a pulse introduced at the start of the measurement by the instrument mechanism. Water is thus imbibed by the tissue, napkin, or towel sample from this central entrance point radially outward by capillary action. When the rate of water imbibation decreases below 0.005 gm water per 5 seconds, the test is terminated. The amount of water removed from the reservoir and absorbed by the sample is weighed and reported as grams of water per square meter of sample or grams of water per gram of sheet. In practice, an M/K Systems Inc. Gravimetric Absorbency Testing System is used. This is a commercial system obtainable from M/K Systems Inc., 12 Garden Street, Danvers, Mass., 01923. WAC, or water absorbent capacity, also referred to as SAT, is actually determined by the instrument itself. WAC is defined as the point where the weight versus time graph has a "zero" slope, i.e., the sample has stopped absorbing. The termination criteria for a test are expressed in maximum change in water weight absorbed over a fixed time period. This is basically an estimate of zero slope on the weight versus time graph. The program uses a change of 0.005 g over a 5 second time interval as termination criteria; unless "Slow SAT" is specified in which case the cut off criteria is 1 mg in 20 seconds.

Water absorbency rate is measured in seconds and is the time it takes for a sample to absorb a 0.1 gram droplet of water disposed on its surface by way of an automated syringe. The test specimens are preferably conditioned at 23° C.±1° C. (73.4° F.±1.8° F.) at 50% relative humidity. For each sample, 4 3×3 inch test specimens are prepared. Each specimen is placed in a sample holder such that a high intensity lamp is directed toward the specimen. 0.1 ml of water is deposited on the specimen surface and a stop watch is started. When the water is absorbed, as indicated by lack of further reflection of light from the drop, the stopwatch is stopped and the time recorded to the nearest 0.1 seconds. The procedure is repeated for each specimen and the results averaged for the sample. SAT Rate is determined by graphing the weight of water absorbed by the sample (in grams) against the square root of time (in seconds). The SAT rate is the best fit slope between 10 and 60 percent of the end point (grams of water absorbed).

Dry tensile strengths (MD and CD), stretch, ratios thereof, break modulus, stress and strain are measured with a standard Instron test device or other suitable elongation tensile tester which may be configured in various ways, typically using 3 or 1 inch wide strips of tissue or towel, conditioned at 50% relative humidity and 23° C. (73.4° F.), with the tensile test run at a crosshead speed of 2 in/min for modulus, 10 in/min for tensile. For purposes of calculating modulus values, inch wide specimens were pulled at 0.5 inches per minute so that a larger number of data points were available. Unless otherwise clear from the context, stretch refers to stretch (elongation) at break. Break modulus is the ratio of peak load to stretch at peak load. Tensile modulus, reported in grams per inch per percent strain, is determined by the same procedure used for tensile strength except that the modulus recorded is the geometric mean of the chord slopes of the cross direction and machine direction load-strain curves from a value of 0 to 100 grams, and a sample width of only one inch is used.

GMT refers to the geometric mean tensile strength of the CD and MD tensile. Tensile energy absorption (TEA) is measured in accordance with TAPPI test method T494 om-01.

Initial MD modulus refers to the maximum MD modulus below 5% strain.

Wet tensile is measured by the Finch cup method. The Finch cup method uses a three-inch wide strip of tissue that is folded into a loop, clamped in the Finch Cup, then immersed in a water. The Finch Cup, which is available from the Thwing-Albert Instrument Company of Philadelphia, Pa., is mounted onto a tensile tester equipped with a 2.0 pound load cell with the flange of the Finch Cup clamped by the tester's lower jaw and the ends of tissue loop clamped into the upper jaw of the tensile tester. The sample is immersed in water that has been adjusted to a pH of 7.0.±0.0.1 and the tensile is tested after a 5 second immersion time. On most test equipment, as the measurement is taken of a loop, the indicated load reading should be divided by two to reflect the intrinsic properties of the sheet.

Wet or dry tensile ratios are simply ratios of the values determined by way of the foregoing methods. Unless otherwise specified, a tensile property is a dry sheet property.

The void volume and/or void volume ratio as referred to hereafter, are determined by saturating a sheet with a nonpolar liquid and measuring the amount of liquid absorbed. The volume of liquid absorbed is equivalent to the void volume within the sheet structure. The percent weight increase (PWI) is expressed as grams of liquid absorbed per gram of fiber in the sheet structure times 100, as noted hereinafter. More specifically, for each single-ply sheet sample to be tested, select 8 sheets and cut out a 1 inch by 1 inch square (1 inch in the machine direction and 1 inch in the cross-machine direction). For multi-ply product samples, each ply is measured as a separate entity. Multiple samples should be separated into individual single plies and 8 sheets from each ply position used for testing. Weigh and record the dry weight of each test specimen to the nearest 0.0001 gram. Place the specimen in a dish containing POROFIL™ liquid having a specific gravity of 1.875 grams per cubic centimeter, available from Coulter Electronics Ltd., Northwell Drive, Luton, Beds, England; Part No. 9902458.) After 10 seconds, grasp the specimen at the very edge (1-2 Millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Lt., Maidstone, England) in order to remove any excess of the last partial drop. Immediately weigh the specimen, within 10 seconds, recording the weight to the nearest 0.0001 gram. The PWI for each specimen, expressed as grams of POROFIL per gram of fiber, is calculated as follows:

$$PWI=[(W_2-W_1)/W_1]\times 100\%$$

wherein

"$W_1$" is the dry weight of the specimen, in grams; and

"$W_2$" is the wet weight of the specimen, in grams.

The PWI for all eight individual specimens is determined as described above and the average of the eight specimens is the PWI for the sample.

The void volume ratio is calculated by dividing the PWI by 1.9 (density of fluid) to express the ratio as a percentage, whereas the void volume (gms/gm or g/g) is simply the weight increase ratio; that is, PWI divided by 100.

Fiber lengths and coarseness incorporated herein are determined using the HiRes Fiber Quality Analyzer manufactured by OpTest Equipment, Inc of Hawksbury, Ontario Canada.

Subjective product attributes are often best evaluated using test protocols in which a consumer uses and evaluates a product. In a "monadic" test, a consumer will use a single product and evaluate its characteristics using a standard scale. In paired comparison tests, the consumers are given samples of two different products and asked to rate each vis-à-vis the other for either specific attributes or overall preference. Sensory softness is a subjectively measured tactile property that approximates consumer perception of sheet softness in normal use. Softness is usually measured by 20 trained panelists and includes internal comparison among product samples. The results obtained are statistically converted to a useful comparative scale.

Fpm refers to feet per minute while consistency refers to the weight percent fiber of the web. A nascent web of 10 percent consistency is 10 weight percent fiber and 90 weight percent water.

Fabric Crepe Ratio is an expression of the speed differential between the creping fabric and the transfer cylinder or surface and is defined as the ratio of the transfer cylinder speed and the creping fabric speed calculated as:

Fabric Crepe Ratio=Forming Fabric speed/Through Drying fabric speed

Fabric Crepe can also be expressed as a percentage calculated as:

Fabric Crepe, percent=(Fabric Crepe Ratio−1)×100%

Reel Crepe is a measure of the speed differential between the Yankee dryer and the take-up reel onto which the paper is being wound and is measured in a similar way:

Reel Crepe Ratio=Yankee Dryer Speed/Reel Speed, and

Reel Crepe, percent=((Yankee Speed−Reel speed)/Yankee Speed)×100%.

Similarly, the Aggregate Crepe Ratio is defined as:

Aggregate Crepe Ratio=Forming Fabric Speed/Reel Speed, and

Aggregate Crepe, percent=(Aggregate Crepe Ratio−1)×100%.

The Aggregate Crepe, expressed as a percent, is indicative of the final MD stretch found in sheets made with this process. The contributions to that overall MD stretch can be broken down into the two major creping components, fabric and reel creping, by using the ratio values. For example, if the forming fabric speed is 5000 fpm, the through drying fabric speed is 4000 fpm and the reel is 3600 fpm, then the following values are obtained:

Aggregate Crepe Ratio 5000/3600=1.39

Aggregate Crepe, percent=39%

Fabric Creping Ratio 5000/4000=1.25

Fabric Crepe %=25%

Reel Crepe Ratio ((4000−3600)/3600=1.10

Reel Crepe, percent=10%

PLI or pli means pounds force per linear inch.

Velocity delta means a difference in speed.

Pusey and Jones hardness (indentation) is measured in accordance with ASTM D 531, and refers to the indentation number (standard specimen and conditions).

Calipers reported herein are 8-sheet calipers unless otherwise indicated. The sheets are stacked and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8-mm) diameter anvils, 539±10 grams dead weight load, and 0.231 in./sec descent rate. For finished product testing, each sheet of product to be tested must have the same number of plies as the product is sold. For base sheet testing off of the paper machine reel, single plies are used with eight sheets being selected and stacked together. Specific volume is determined from basis weight and caliper.

Example 1

Towel base sheets were produced on a TAD paper machine having the configuration shown in FIG. 2. The base sheets were produced using a furnish containing sixty percent Southern SWK and forty percent Southern HWK. The base sheet also contained broke in amounts ranging from seventeen to twenty-five percent of the total furnish. The sheets were produced using a three-layered head box with the layer that contacted the Yankee dryer comprised of 100% SWK. The sheet was shaped on a Voith 44G TAD fabric having a standard warp and a contact area of eighteen percent. Refining was used to control the dry strength of the base sheets, while wet strength and wet/dry ratio was produced by addition of a polyaminoamide epichlorohydrin permanent wet strength resin and carboxymethylcellulose to the wet end. Hercules Prosoft TQ-456, an imidazolinium-based debonder containing a poly-propylene glycol oleate was added to wet end during manufacture of one of the towel base sheets in the amount of 5.5 lbs/ton. The sheets were creped at a fabric crepe of 18 to 20 percent, while the reel crepe ranged from −0.3 to 0.2 percent. The sheets were creped from the Yankee dryer using a creping blade having a blade of twenty degrees. The base sheets were dried to about 80 percent solids on the through-dryer while the reel moisture was controlled to a value of between 2.0 and 2.5 percent. The physical properties of the base sheets are shown in Table 1-1.

TABLE 1-1

Base Sheet Physical Properties

| Product | G-2 (No Debonder) | G-3 (Debonder Added) |
|---|---|---|
| Basis Weight (lbs/ream) | 19.15 | 19.10 |
| Caliper (mils/8 sheets) | 106.1 | 114.8 |
| MD Tensile (g/3") | 2853 | 1578 |
| CD Tensile (g/3") | 2510 | 1594 |
| GM Tensile (g/3") | 2675 | 1586 |
| Tensile Ratio | 1.14 | 0.99 |
| MD Stretch (%) | 16.8 | 18.6 |
| CD Stretch (%) | 6.4 | 6.4 |
| CD Wet Tensile - Finch (g/3") | 764 | 490 |
| CD Wet/Dry - Finch (%) | 30.4 | 30.8 |
| SAT Capacity (g/sq meter) | 539 | 511 |
| SAT Capacity (g/g) | 8.7 | 8.2 |
| SAT Rate (g/sec 0.5) | 0.18 | 0.16 |
| GM Break Modulus (g/%) | 254.6 | 143.6 |
| GM Tensile Modulus (g/in/%) | 140.3 | 76.1 |

Figure 3A:
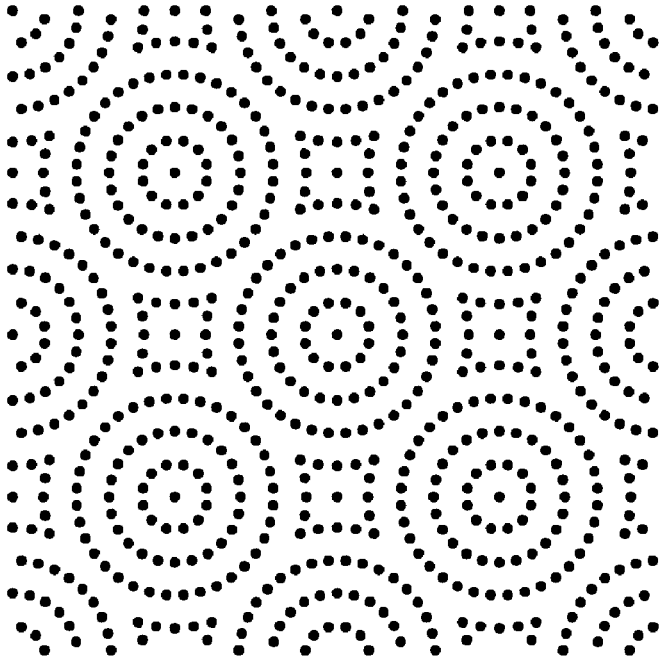
Figure 3B:
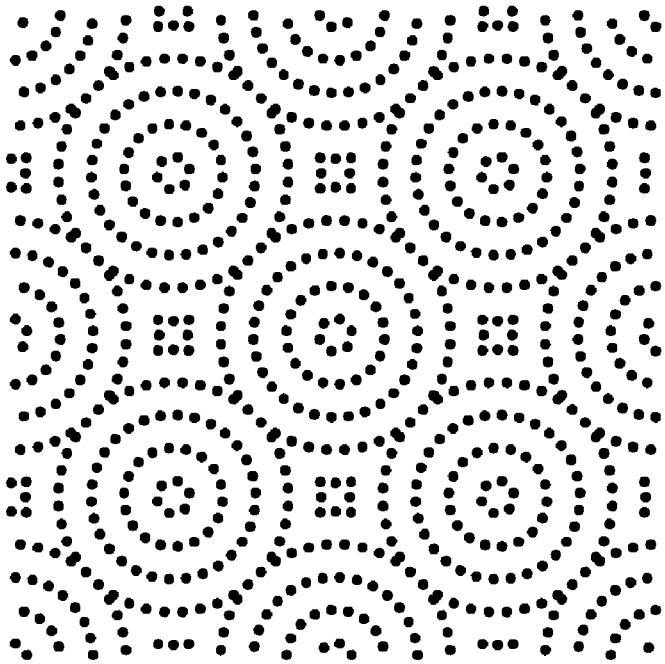
Figure 4:
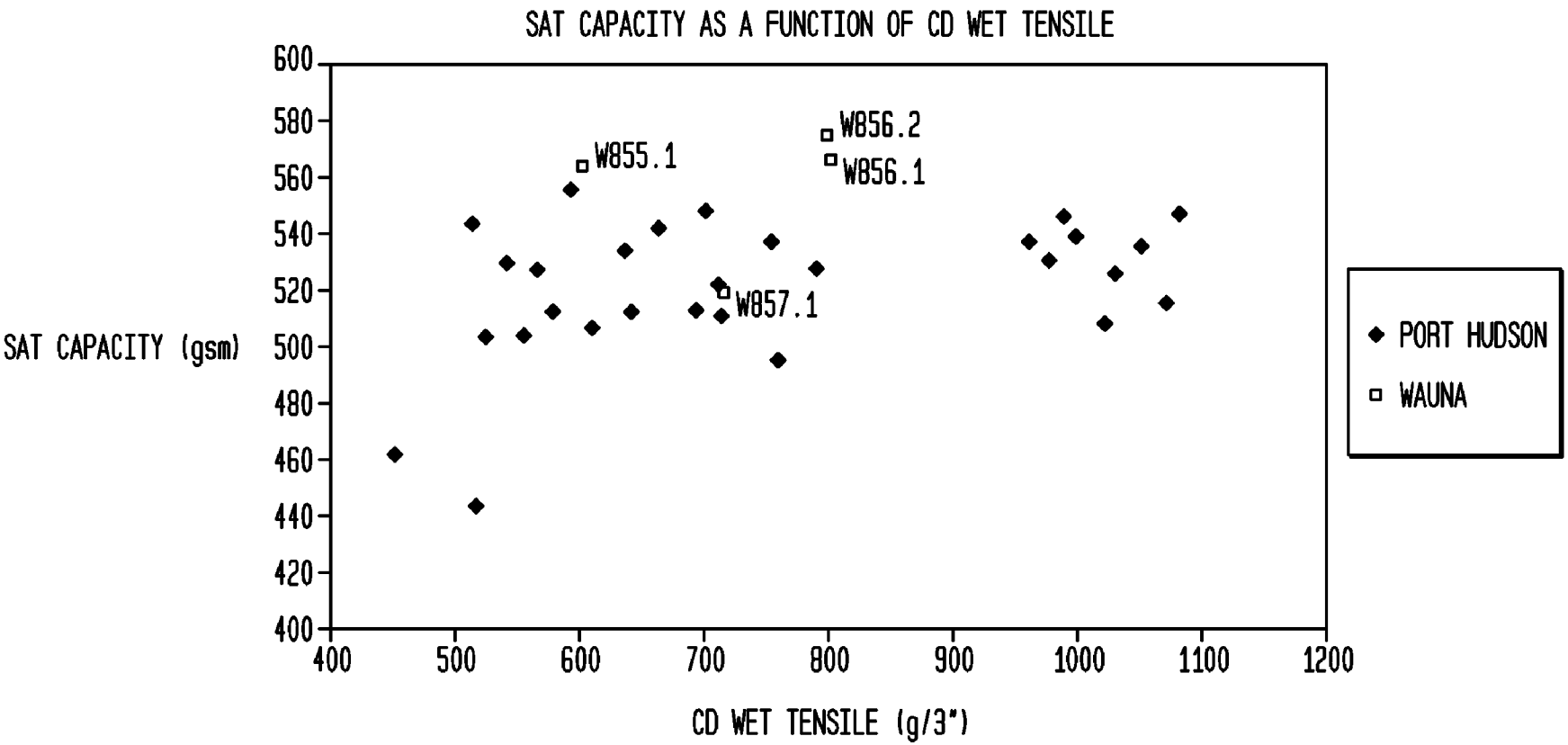
FIG. 4 presents the SAT absorbent capacity of examples of the present invention relative to their CD wet tensile strength.

The base sheets were converted to finished product by embossing them using the emboss pattern shown in FIGS. 3A and 3B. The finished product properties are shown in Table 2-2. As a reference, the physical properties of competitive product "V", a high-weight double-recreped product are also shown. In consumer tests, this product has received the highest scores for overall performance and for most important attribute ratings of any commercially-available product in our experience.

TABLE 1-2

Finished Product Physical Properties

| Product | PH47.1 (G-2) | PH48.1 (G-3) | "V" (Average of two samples) |
|---|---|---|---|
| Basis Weight (lbs/ream) | 36.92 | 36.65 | 41.7 |
| Caliper (mils/8 sheets) | 239.1 | 239.8 | 211.6 |
| MD Tensile (g/3") | 4802 | 2196 | 1423 |
| CD Tensile (g/3") | 3565 | 1742 | 933 |
| GM Tensile (g/3") | 4137 | 1956 | 1152 |
| Tensile Ratio | 1.35 | 1.26 | 1.53 |
| MD Stretch (%) | 16.0 | 17.1 | 22.4 |
| CD Stretch (%) | 8.2 | 8.3 | 17.6 |
| CD Wet Tensile - Finch (g/3") | 1001 | 515 | 522 |
| CD Wet/Dry - Finch (%) | 28.1 | 29.5 | 55.9 |
| Perf Tensile (g/3") | 961 | 431 | 367 |
| SAT Capacity (g/sq meter) | 539 | 544 | 568 |
| SAT Capacity (g/g) | 8.97 | 9.11 | 8.37 |
| SAT Rate (g/sec^0.5) | 0.20 | 0.15 | 0.12 |
| GM Break Modulus (g/%) | 363.8 | 163.9 | 58.2 |
| GM Tensile Modulus (g/in/%) | 77.4 | 37.7 | 14.1 |
| Macbeth Brightness (%) | 79.1 | 79.4 | 84.2 |
| Macbeth L* | 94.4 | 94.7 | 96.5 |
| Macbeth a* | −0.74 | −0.88 | −1.0 |
| Macbeth b* | 5.65 | 5.99 | 5.31 |
| Roll Diameter (inches) | 5.60 | 5.58 | 4.88 |
| Roll Compression (%) | 9.6 | 8.0 | 7.4 |
| Sensory Softness | 3.84 | 7.88 | 13.9 |

Both the product prototypes and competitive product "V" were placed in Monadic Home Use tests. The test results are shown in Table 1-3. The results show that the softer prototype, G-3, was preferred by consumers over the G-2 towel for overall performance. Surprisingly, the softer product had a substantially higher overall rating, even though the stronger G-2 product had equivalent ratings for most product attributes, except those related to product softness. Also, the G-3 product obtained an overall performance rating and similar scores for most attributes to the competitive "V" towel. It is considered quite surprising that the product of the present invention is able to so closely match a product made by the far more expensive double recrepe process on absorbency, strength and thickness and actually achieve an overall acceptance rating equivalent to that of the very high end retail towel "V". On monadic HUT evaluations, we have found that a difference of 3 points is typically significant at about the 90% confidence level—there is a 90% probability that consumers will on average rate the higher testing product as significantly better.

TABLE 1-3

Monadic HUT Ratings (0-100)

| Product | Overall Rating | Absorbency Rating | Strength Rating | Thickness Rating | Softness Rating |
|---|---|---|---|---|---|
| G-2 | 81 | 87 | 89 | 88 | 48 |
| G-3 (Current Invention) | 87 | 88 | 85 | 86 | 76 |
| "V" (avg. of two HUT's) | 86 | 88 | 87 | 88 | 91 |

Example 2

Premium 2-ply TAD towel basesheets were produced having two CD wet strength targets (i.e., 470 g/3" and 740 g/3") with two levels of basis weight (17.7 lb/rm and 19.3 lb/rm).

Webs were formed using 60% pine, 40% hardwood plus 30% broke, base sheet strength being altered by changing refining levels (i.e., pine and Yankee side layer furnishes were refined to different levels of freeness). Target GM tensile strength levels for the trial were: 1600 g/3" & 2700 g/3" as set forth in Table 2-1.

TABLE 2-1

Experimental Design - Super Premium TAD Towel Base Sheet

| Factors | Levels |
|---|---|
| Target Furnish | 60%-Pine/40%-Hardwood/30%-Broke |
| Refining | Pine refiner varied to control strength<br>Yankee layer tickler refiner varied to control strength |
| Wet Strength Resin (Amres) | ~16.0 lb/ton |
| Dry Strength Resin (CMC) | ~2.7 lb/ton |
| Wet End Softener (Hercules TQ-456) | None or 5.5 lb/ton (overall) on an as received basis.<br>2.75 lb/T added to the suction side of Air Layer blend chest stock pump and<br>2.75 lb/T added to the suction side of the suction side of Middle Layer blend chest stock pump |
| Fabric Crepe Level | 16 to 19% |
| TAD Fabric Style | Voith 44G, standard warp at 18% contact area |
| TAD Spray Release | ~70 mg/m$^2$ |
| Post TAD No. 2 Moisture | ~18% |
| Yankee Crepe Adhesive | ~33 mg/m$^2$ |
| Crepe Blade Bevel, degrees | 20° |
| Reel Crepe | 2.2 to 2.7% |
| Target Basis Weight, lb/3000 ft2 | 16.5 and 17.9 (OD)<br>17.7 and 19.3<br>(Conditioned to 7% Moisture) |

Table 2-2 gives the detailed process conditions used to make the base sheets. As can be seen from the table, for one of the prototypes, the addition of debonder was required in order to obtain the desired physical properties. No debonder was needed to produce the other base sheets. The base sheet physical properties are shown in Table 2-3.

TABLE 2-2

Paper Machine Process Conditions Used to Make Super Premium TAD Towel Base Sheets

| | Trial Cell ID | | | |
|---|---|---|---|---|
| | Q-1 | Q-2 | Q-3 | Q-4 |
| Prototype Description | Low str Med wt | Low str High wt. | High str Med wt. | High str High wt |
| Fabric Crepe, % | 16.0 | 17.0 | 18.5 | 18.5 |
| Pine/Hardwood/Broke, % | 60/40/30 | 60/40/30 | 60/40/30 | 60/40/30 |
| Yankee Layer: Pine/HW/Broke, % | 100/0/0 | 100/0/0 | 100/0/0 | 100/0/0 |
| Middle Layer: Pine/HW/Broke, % | 0/100/91 | 0/100/91 | 0/100/91 | 0/100/91 |
| Air Layer: Pine/HW/Broke, % | 26/74/0 | 26/74/0 | 26/74/0 | 26/74/0 |
| Reel Crepe, % | +2.4 | +2.0 | +2.1 | +2.4 |
| Reel Speed, fpm | 3515 | 3564 | 3354 | 3344 |
| TAD Release, mg/m$^2$ | 70 | 70 | 70 | 70 |
| Wet Strength Resin, lbs/ton | 15.8 | 15.8 | 15.0 | 15.0 |
| Dry Strength Resin, lbs/ton | 2.7 | 2.7 | 2.4 | 2.4 |

TABLE 2-2-continued

| Paper Machine Process Conditions Used to Make Super Premium TAD Towel Base Sheets | Trial Cell ID | | | |
|---|---|---|---|---|
| | Q-1 | Q-2 | Q-3 | Q-4 |
| Wet End Softener (TQ-456) AL/ML, lbs/ton of production | 0/0 | 2.75/2.75 | 0/0 | 0/0 |
| Crepe Adhesive-Total, mg/m$^2$ | 33.0 | 33.0 | 33.0 | 33.0 |
| PVOH, mg/m$^2$ | 19.6 | 19.6 | 19.6 | 19.6 |
| PAE, mg/m$^2$ | 13.1 | 13.1 | 13.1 | 13.1 |
| Modifier, mg/m$^2$ | 0.3 | 0.3 | 0.3 | 0.3 |
| Crepe Blade, degrees | 20 | 20 | 20 | 20 |
| Reel Moisture, % | 2.6 | 2.7 | 2.2 | 2.6 |
| Post TAD No. 2 Moisture, % | 17.5 | 18.5 | 18.0 | 17.9 |
| Fabric Crepe, % | 16.0 | 17.0 | 18.5 | 18.5 |

TABLE 2-3

| Physical Property Data - Tested after TAPPI conditioning | | | | |
|---|---|---|---|---|
| Properties | Q-1 | Q-2 | Q-3 | Q-4 |
| Prototype Description | Low Strength/ Medium Weight | Low Strength/ High Weight | High Strength/ Medium Weight | High Strength/ High Weight |
| Basis Weight, lb/rm | 18.16 | 19.73 | 17.89 | 19.30 |
| Caliper, mils/8 sheets | 108.14 | 116.64 | 101.46 | 109.50 |
| MDT, g/3" | 1750.50 | 1667.87 | 2868.44 | 3004.33 |
| CDT, g/3" | 1825.50 | 1677.53 | 2757.22 | 2818.00 |
| GMDT, g/3" | 1786.82 | 1672.36 | 2812.28 | 2909.02 |
| MDST, % | 22.15 | 21.86 | 22.92 | 22.60 |
| CDST, % | 6.57 | 6.17 | 6.86 | 6.62 |
| Tensile Ratio | 0.96 | 1.00 | 1.04 | 1.07 |
| GM Break Mod, g/% | 147.26 | 143.35 | 223.59 | 238.65 |
| CWDT-Finch, g/3" | 538.10 | 542.90 | 838.12 | 830.37 |
| Wet/Dry Ratio, % | 0.30 | 0.32 | 0.30 | 0.29 |
| SAT (2-ply), g/m$^2$ | 575.12 | 560.65 | 616.78 | 574.35 |

Example 3

Four premium 2-ply TAD towel basesheets were produced including

Cell R-1: 16.2 lb/rm and 640 g/3" CDWT;

Cell R-2: 16.2 lb/rm and 485 g/3" CDWT;

Cell R-3: 17.7 lb/rm and 640 g/3" CDWT; and

Cell R-4: 19.3 lb/rm and 640 g/3" CDWT.

All basesheets were produced without addition of softener. Toweling web was formed using 60% pine, 40% hardwood plus 30% broke. Basesheet strength was altered by changing refining levels (i.e., pine and Yankee-side layer furnishes were refined to different levels of freeness). The target GM tensile strength levels for the trial were: 1640 g/3" (Low Tensile Strength) and 2200 g/3" (Medium Tensile Strength).

Details of the experimental design are given in Table 3-1.

TABLE 3-1

| Super Premium TAD Towel Basesheet | |
|---|---|
| Factors | Levels |
| Target Furnish | 60%-Pine/40%-Hardwood/30%-Broke |
| Refining | Pine refiner varied to control strength<br>Yankee layer tickler refiner varied to control strength |
| Wet Strength Resin (Amres) | ~13.3 lb/ton |
| Dry Strength Resin (CMC) | ~2.7 lb/ton |
| Wet End Softener (Hercules TQ-456) | None. |
| Fabric Crepe Level | 16 to 19% |
| TAD Fabric Style | Voith 44G, standard warp at 18% contact area |
| TAD Spray Release | ~60 mg/m$^2$ |
| Post TAD No. 2 Moisture | ~18% |
| Yankee Crepe Adhesive Add-on | ~33 mg/m$^2$ |
| Crepe Blade Bevel, degrees | 20° |
| Reel Crepe | 1.0 to 2.0% |
| Target Basis Weight, lb/3000 ft$^2$ | 16.2, 17.7, and 19.3 (Conditioned to 7% Moisture) |

Table 3-2 gives the detailed process conditions used to make the four basesheets. Table 3-3 gives the detailed physical property data for the basesheets made during the trial.

TABLE 3-2

| Paper Machine Process Conditions Used to Make Super Premium TAD Towel Basesheets Table | Trial Cell ID | | | |
|---|---|---|---|---|
| | R-1 | R-2 | R-3 | R-4 |
| Prototype Description | 16.2 lb/rm/ Medium Strength | 16.2 lb/rm/ Low Strength | 17.7 lb/rm/ Medium Strength | 19.3 lb/rm/ Medium Strength |
| Rush/Drag, fpm | 304 | 300 | 300 | 300 |
| Fabric Crepe, % | 16.0 | 16.0 | 18.0 | 18.0 |
| Pine/Hardwood/Broke, % | 60/40/30 | 60/40/30 | 60/40/30 | 60/40/30 |
| Yankee Layer: Pine/HW/Broke, % | 100/0/0 | 100/0/0 | 100/0/0 | 100/0/0 |
| Middle Layer: Pine/HW/Boke, % | 0/9/91 | 0/9/91 | 0/9/91 | 0/9/91 |
| Air Layer: Pine/HW/Broke, % | 26/74/0 | 26/74/0 | 26/74/0 | 26/74/0 |
| Reel Crepe, % | +2.0 | +1.6 | +1.0 | +1.0 |
| Reel Speed (fpm) | 3822 | 3840 | 3368 | 3414 |
| TAD Release, mg/m$^2$ | 60 | 60 | 60 | 60 |
| Wet Strength Resin, lbs/ton | 13.3 | 13.3 | 13.2 | 13.4 |
| Dry Strength Resin, lbs/ton | 2.7 | 2.7 | 2.7 | 2.8 |
| Crepe Adhesive-Total, mg/m$^2$ | 33.0 | 33.0 | 32.0 | 32.0 |
| PVOH, mg/m$^2$ | 19.0 | 19.0 | 18.4 | 18.4 |
| PAE, mg/m$^2$ | 13.7 | 13.7 | 13.3 | 13.3 |
| Modifier, mg/m$^2$ | 0.3 | 0.3 | 0.3 | 0.3 |

TABLE 3-2-continued

| Paper Machine Process Conditions Used to Make Super Premium TAD Towel Basesheets Table | Trial Cell ID | | | |
|---|---|---|---|---|
| | R-1 | R-2 | R-3 | R-4 |
| Reel Moisture, % | 2.8 | 2.5 | 2.5 | 2.8 |
| Post TAD No. 2 Moisture, % | 17.7 | 17.3 | 17.7 | 17.7 |

TABLE 3-3

| Physical Property Data - TAPPI Conditioned | | | | |
|---|---|---|---|---|
| Properties | R-1 | R-2 | R-3 | R-4 |
| Prototype Description | Med. Strength/ Low Weight | Low Strength/ Low Weight | Med. Strength/ Medium Weight | Med. Strength/ High Weight |
| Parent Roll Nos. | 15-16 | 27 & 29 | 10-11 | 13 & 15 |
| Date Made | Mar. 13, 2007 | Mar. 13, 2007 | Mar. 14, 2007 | Mar. 14, 2007 |
| Basis Weight, lb/rm (cond.) | 16.20 | 16.46 | 17.89 | 19.52 |
| Caliper, mils/8 sheets | 108.2 | 116.0 | 110.0 | 113.7 |
| MDT, g/3" | 2123 | 1625 | 2212 | 2127 |
| CDT, g/3" | 2313 | 1763 | 2215 | 2302 |
| GMDT, g/3" | 2216 | 1692 | 2213 | 2211 |
| MDST, % | 18.44 | 19.58 | 20.65 | 20.51 |
| CDST, % | 7.04 | 6.61 | 6.78 | 6.66 |
| Tensile Ratio | 0.92 | 0.92 | 1.00 | 0.93 |
| GMBk Mod, g/% | 196.55 | 148.54 | 188.03 | 190.96 |
| CWDT-Finch, g/3" | 614.7 | 550.7 | 722.6 | 668.8 |
| Wet/Dry Ratio, % | 0.27 | 0.31 | 0.33 | 0.29 |
| SAT (2-ply), g/m$^2$ | 595.2 | 611.6 | 605.3 | 619.9 |

Example 4

Seven TAD towel base sheets from the previous two Examples were converted to two-ply finished products. The trial prototypes were produced at a sheet length of 11 inches and a sheet count of 56.

The trial prototypes were produced on a commercial towel winder using the nested emboss pattern shown in FIGS. 3A and 3B. Emboss penetration was adjusted to produce a product having a caliper of approximately 240 mils/8 sheets. The same emboss settings were used to produce all seven trial prototypes. Roll diameter was not controlled; however all trial prototypes had diameters of approximately 5.3 inches. The winding tension was set to deliver rolls having a compression of approximately seven percent. The trial products were produced at a speed of 1000 fpm. The settings for the converting line are shown in Table 4-1.

TABLE 4-1

| Converting Line Settings | |
|---|---|
| Emboss Nip Top Roll (inches) | 1.75 |
| Emboss Nip Bottom Roll (inches) | 1.75 |
| Marrying Roll Nip (inches) | 0.5625 |
| Top Rubber Roll Durometer (Shore A) | 56 |
| Bottom Rubber Roll Durometer (Shore A) | 52 |
| Draw Roll Gap (inches) | 0.035 |
| Line Speed (fpm) | 1000 |

In addition to the prototypes produced at a sheet length of 11 inches, one of the base sheets (Q1) was converted to finished product at a sheet length of 10 inches. The towel products were tested for standard physical properties while sensory softness was measured by a trained panel. The results of these tests are shown in Table 4-2.

TABLE 4-2

| Physical Properties, Fiber Properties, and Paired HUT Results | | | | | | | | | |
|---|---|---|---|---|---|---|---|---|---|
| Product (Base Sheet Cell) | PH 66.3 (Q2) | PH 73.1 (R4) | PH 68.3 (Q4) | PH 65.3 (Q1) | PH 72.1 (R3) | PH 71.1 (R2) | PH 70.1 (R1) | PH 65.1 (Q1) | "B" (Market Leading Brand) |
| Basis Weight (lbs/ream) | 35.95 | 36.05 | 36.16 | 33.31 | 33.26 | 30.04 | 30.27 | 34.11 | 27.70 |
| Caliper (mils/8 sheets) | 238.4 | 243.0 | 245.0 | 235.8 | 240.4 | 235.7 | 242.1 | 220.6 | 192.7 |
| MD Tensile (g/3") | 2493 | 3424 | 4784 | 2684 | 3390 | 2415 | 3031 | 3025 | 3045 |
| CD Tensile (g/3") | 1877 | 2585 | 3437 | 2093 | 2490 | 1961 | 2547 | 2458 | 2122 |
| GM Tensile (g/3") | 2162 | 2974 | 4053 | 2368 | 2904 | 2175 | 2777 | 2726 | 2540 |
| MD Stretch (%) | 14.6 | 14.4 | 16.2 | 13.8 | 14.5 | 12.8 | 12.9 | 16.4 | 16.2 |
| CD Stretch (%) | 7.8 | 8.3 | 7.6 | 7.8 | 8.2 | 8.2 | 8.0 | 7.3 | 14.1 |
| CD Wet Tensile - Finch (g/3") | 578 | 755 | 1053 | 609 | 711 | 555 | 792 | 693 | 687 |
| CD Wet/Dry - Finch (%) | 30.8 | 29.2 | 30.7 | 29.2 | 28.6 | 28.4 | 31.1 | 28.1 | 32.4 |
| Perf Tensile (g/3") | 606 | 908 | 1196 | 726 | 893 | 706 | 888 | 730 | 769 |
| SAT Capacity (g/m$^2$) | 512 | 537 | 536 | 506 | 522 | 503 | 527 | 512 | 565 |
| SAT Capacity (g/g) | 8.7 | 9.1 | 9.1 | 9.3 | 9.6 | 10.3 | 10.7 | 9.2 | 12.5 |
| SAT Rate (g/sec$^{0.5}$) | 0.20 | 0.26 | 0.24 | 0.25 | 0.23 | 0.26 | 0.25 | 0.24 | 0.18 |

TABLE 4-2-continued

Physical Properties, Fiber Properties, and Paired HUT Results

| Product (Base Sheet Cell) | PH 66.3 (Q2) | PH 73.1 (R4) | PH 68.3 (Q4) | PH 65.3 (Q1) | PH 72.1 (R3) | PH 71.1 (R2) | PH 70.1 (R1) | PH 65.1 (Q1) | "B" (Market Leading Brand) |
|---|---|---|---|---|---|---|---|---|---|
| GM Break Modulus (g/%) | 204.1 | 277.9 | 369.1 | 229.3 | 266.9 | 211.7 | 275.5 | 249.4 | 172.3 |
| GM Tensile Modulus (g/in/%) | 47.0 | 60.4 | 73.8 | 50.5 | 58.2 | 49.7 | 61.2 | 48.0 | 43.9 |
| Roll Diameter (inches) | 5.24 | 5.31 | 5.32 | 5.27 | 5.31 | 5.27 | 5.32 | 5.09 | 4.89 |
| Roll Compression (%) | 7.3 | 7.1 | 7.6 | 8.1 | 7.5 | 8.2 | 6.6 | 9.6 | 10.4 |
| Sensory Softness | 6.54 | 5.69 | 4.12 | 5.91 | 4.98 | 5.80 | 4.18 | 6.37 | 7.91 |
| Fiber Properties | | | | | | | | | |
| $L_n$ (mm) | 0.34 | 0.36 | 0.35 | 0.33 | 0.31 | 0.31 | 0.31 | 0.33 | 0.62 |
| $L_w$ (mm) | 1.31 | 1.50 | 1.36 | 1.27 | 1.37 | 1.37 | 1.32 | 1.29 | 1.41 |
| $L_z$ (mm) | 2.31 | 2.54 | 2.36 | 2.26 | 2.44 | 2.44 | 2.36 | 2.26 | 2.16 |
| Coarseness (mg/100 m) | 12.05 | 15.24 | 12.54 | 12.53 | 12.87 | 12.76 | 12.92 | 12.17 | 10.95 |
| $C/L_z$ (mg/100 m/mm) | 5.23 | 6.00 | 5.32 | 5.54 | 5.28 | 5.23 | 5.48 | 5.38 | 5.07 |
| Fines (num %) | 70.88 | 72.86 | 70.88 | 72.14 | 76.53 | 76.12 | 76.03 | 71.70 | 38.15 |
| Fines (wt %) | 16.25 | 16.39 | 16.01 | 17.55 | 19.78 | 19.43 | 20.08 | 17.03 | 4.83 |
| Paired HUT Results | | | | | | | | | |
| Number of Respondents | 322 | 322 | 333 | 302 | 322 | 314 | 309 | 302 | — |
| Preferred Prototype (%) | 57 | 57 | 44 | 48 | 51 | 45 | 44 | 48 | — |
| No Preference (%) | 19 | 13 | 11 | 22 | 14 | 21 | 14 | 22 | — |
| Preferred Market Leader "B" (%) | 24 | 30 | 44 | 30 | 35 | 34 | 42 | 30 | — |

From the table, the benefit of increased basis weight in obtaining softness can be seen. Products PH 73.1, PH 72.1, and PH 70.1 have similar (dry) strength values and were made from similar furnish blends. However, the results of the testing of the products' softness by a trained panel demonstrate that the sensory softness increases with increasing basis weight. Even though the prototype having the highest basis weight of these three towels (PH73.1) has (directionally) higher strength, higher fiber coarseness, and higher C/Lz (all generally detrimental to softness), it has better softness than the lower-weight products.

The prototypes whose data are shown in Table 9-3 were tested in paired Home Use Tests against towel product "B", the current market leader, which is made of premium fiber including about 40 percent eucalyptus. It was found that all of the prototypes scored at least equal to, and, in most cases, better than, product "B". This consumer preference for the products of the present invention, despite their higher coarseness and $C/L_z$ values, is considered quite surprising in view of B's advantage in some physical properties and softness. The data also show surprising degree of influence of basis weight (higher is better) and softness (higher is better) on preference scores.

Example 5

Prototype base sheets for premium 2-ply TAD towels were prepared having different levels of strength and softness to be used in forming prototype finished premium 2-ply TAD towel having superior softness as well as more easily measured physical attributes (such as thickness, strength and absorbency) for evaluation in home-use testing against Bounty®, a leading competitive TAD product made from a premium furnish having a basis weight of 27.5 lb/rm with 40% eucalyptus. Prototypes were manufactured at 36 lb/rm in low and intermediate strengths. 36 lb/rm prototypes were prepared, at a moderate wet strength level (CDWT ~550-600 g/3") and a stronger variant at (CDWT ~650-700 g/3"). After converting the basesheets were used to prepare 56-count ~5.3" diameter rolls of standard kitchen roll towel width of 11.0".

A TAD machine having the configuration shown in FIG. 2 with a 3-layer stratified headbox produced towel basesheets using a furnish of 70% fiber blend B2, a 100% softwood Kraft and 30% of fiber blend B1, each having the fiber properties set forth in Table 5-1:

TABLE 5-1

| ID | number weighted fiber length $L_n$ (mm) | length weighted fiber length $L_w$ (mm) | weight weighted fiber length $L_z$ (mm) | Number % Fines $F_n$ | Weight % Fines $F_w$ | Coarseness C mg/100 m | $C/L_z$ | Nf/g Millions of fibers per gram |
|---|---|---|---|---|---|---|---|---|
| B1 | 0.36 | 0.92 | 1.62 | 53.6 | 13.80 | 15.2 | 9.38 | 18.5 |
| B2 | 0.78 | 2.25 | 2.94 | 53.3 | 6.46 | 16.2 | 5.49 | 8.0 |
| Blend | 0.57 | 1.83 | 2.73 | 53.5 | 8.76 | 15.8 | 5.80 | 11.1 |

The coarseness of a blend of fibers can be determined using the formula:

$$1/C_t = W_1/C_1 + W_2/C_2$$

These products were produced without use of any retention aid. The prototypes were produced using an Albany 44G—standard warp through-drying fabric at 17.9% contact area. The jet-to-wire ratio was adjusted to maintain an MD/CD Tensile Ratio of about 1.0. After the machine was stabilized, the basis weight and refining were adjusted to produce a 19.3 lb/rm basesheet at a strength level of 475 g/3" CDWT. Thereafter, the basis weight and refining were adjusted to produce a 19.3 lb/rm basesheet at a strength level of 560 g/3" CDWT. Polyaminoamide epichlorohydrin permanent wet strength resin and carboxymethylcellulose were added in the wet-end at levels adjusted as needed to achieve the desired basesheet tensile strength and wet/dry ratio targets. Headbox pH was maintained at 7 to 8 while headbox charge was monitored to insure that the charge is between 0 and −0.30 ml of 10-3 N titer/10 ml solution (− 0.030 meq per ml) to ensure that wet strength resin retention was acceptable. For one of the prototypes, Hercules TQ-456, an imidazolinium-based debonder containing a poly-propylene glycol oleate was added to the outlet of the middle and air-side blend chest pumps to achieve an improved wet-over-dry tensile level. For this prototype, refining was adjusted to produce a basesheet with a CDWT level of strength approximately 550 g/3". Throughout the trials, line crepe (approximately fabric crepe plus reel crepe) was maintained in the neighborhood of 20-22% with the reel crepe being generally held to less than 3% and in most cases, less than 1 or 2%. The basesheets were dried to about 85% solids on the through-dryer while the reel moisture was maintained at less than about 3.0%.

Basesheets having the properties set forth in Table 5-2 were produced:

TABLE 5-2

Base Sheet Physical Properties

| | Base Sheet ID | | |
|---|---|---|---|
| | S2 | S3 | S4 |
| Used in Prototypes | W855.1 | W856.1<br>W856.2 | W857.1 |
| Basis Weight (lbs/ream) | 19.42 | 19.66 | 19.54 |
| Caliper (mils/8 sheets) | 117.5 | 116.6 | 116.5 |
| MD Tensile (g/3") | 1631 | 1936 | 1754 |
| CD Tensile (g/3") | 1718 | 1958 | 1693 |
| GM Tensile (g/3") | 1673 | 1945 | 1722 |
| MD Stretch (%) | 28.7 | 29.6 | 28.8 |
| CD Stretch (%) | 7.4 | 7.4 | 7.2 |
| CD Wet Tensile - Finch (g/3") | 462 | 564 | 544 |
| CD Wet/Dry - Finch (%) | 26.9 | 28.8 | 32.1 |
| SAT Capacity (g/sq meter) | 631 | 641 | 598 |
| SAT Capacity (g/g) | 10.0 | 10.0 | 9.4 |
| SAT Rate (g/sec$^{0.5}$) | 0.32 | 0.34 | 0.22 |
| GM Break Modulus (g/%) | 115.3 | 131.4 | 119.9 |

TAD towel prototypes were produced from three trial base sheets S2, S3 and S4 as described above at 56 sheet count in a sheet length of 10.5 inches. The S3 base sheet was also converted to a product having a sheet length of 11.0 inches.

The trial prototypes were produced using the nested Emboss pattern shown in FIGS. 3A and 3B using new rubber backing and marrying rolls having hardnesses of 60-62 Shore A, and 90-95 Shore A, respectively. The converting line's feed rolls were set at gaps of 35 mils. Emboss penetration was increased until the targeted caliper of approximately 240 mils/8 sheets was obtained. The emboss settings as shown in Table 5-3 were used to produce finished product rolls at a speed of 1200 fpm. Products produced from the S3 higher-strength base sheet had higher-than-expected wet tensile values, due to lower-than-expected breakdowns during the embossing process.

TABLE 5-3

Emboss Roll Settings

| Roll | Emboss Nip Width (inches) |
|---|---|
| Upper Emboss | 1.25 |
| Lower Emboss | 1.625 |
| Marrying | 0.50 |

Figure 5:
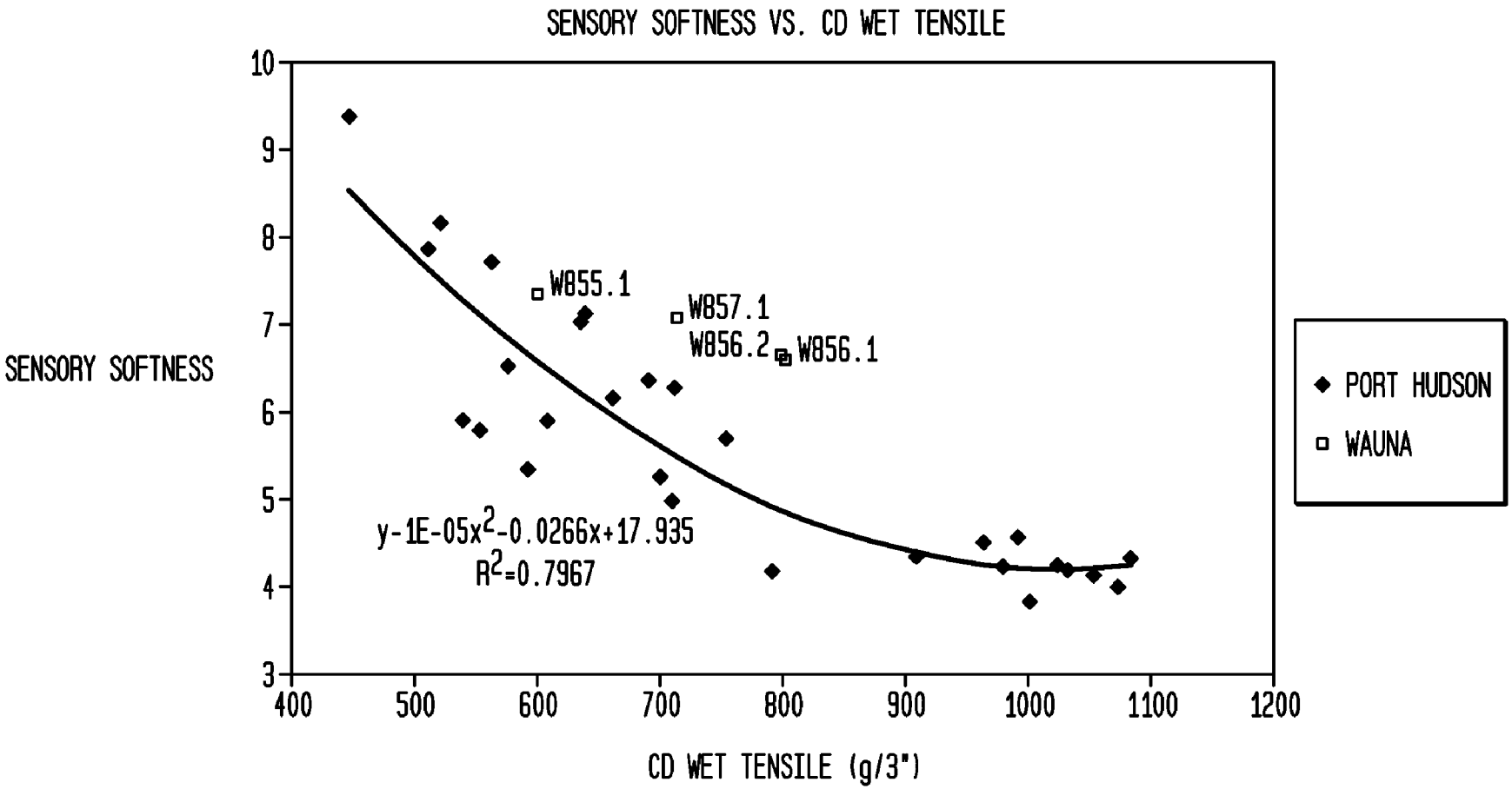
FIG. 5 presents the Sensory Softness of examples of the present invention relative to their CD wet tensile strength.
Figure 6:
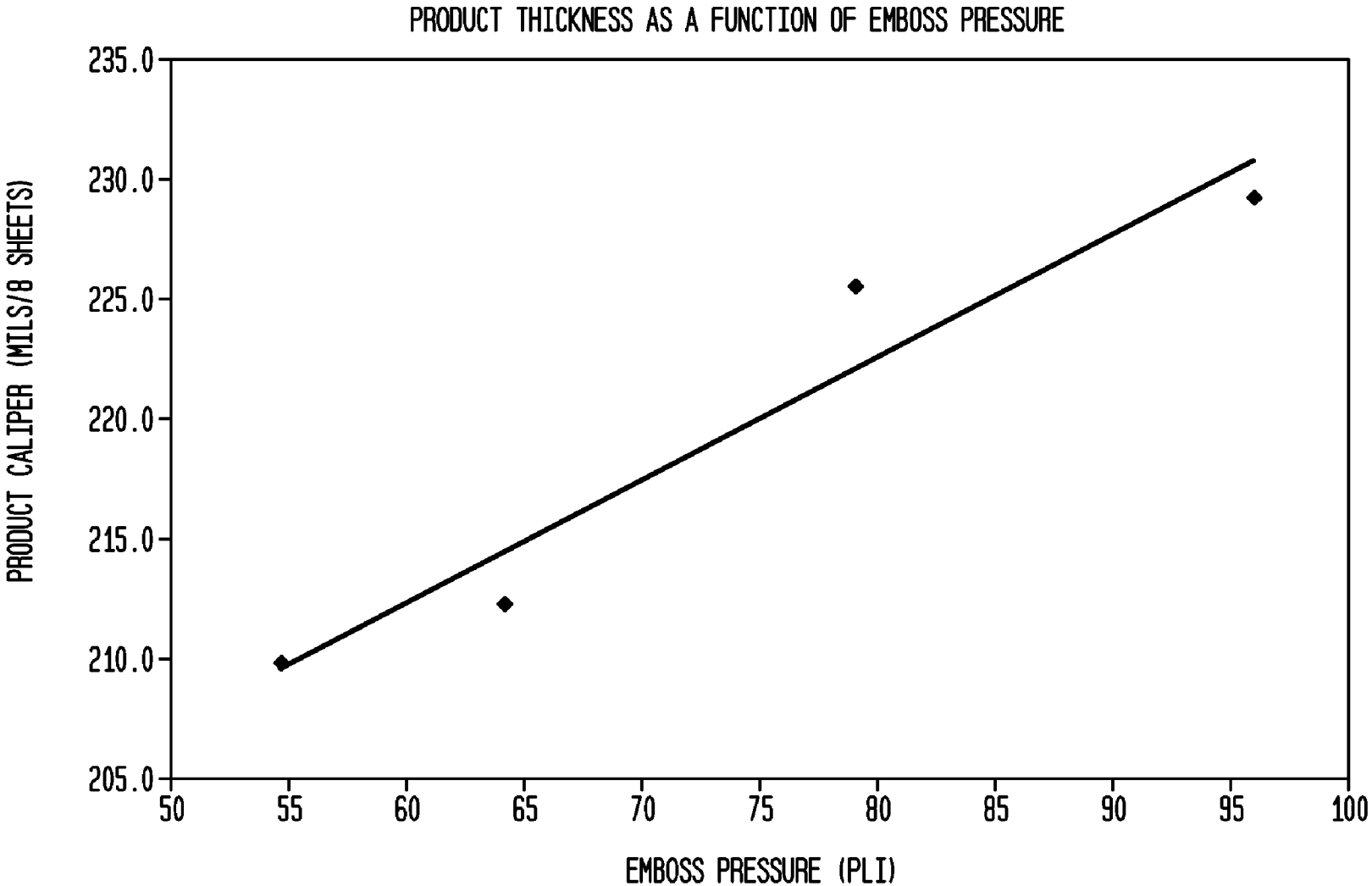
FIGS. 6, 7 and 8 demonstrate the surprising effect of embossing and caliper upon absorbency.

Finished products were tested for standard physical properties while sensory softness values of the prototypes were measured by a trained panel with the results being as shown in Table 5-4. Trial data are also illustrated in FIGS. 5 and 6 which also presents results from previous trials of similar product as a reference. In sensory softness measured on this scale, a difference of about 0.8 pts can typically be considered statistically significant.

TABLE 5-4

Finished Product Physical Properties

| | Product ID | | | |
|---|---|---|---|---|
| | W855.1 | W856.1 | W856.2 | W857.1 |
| Base Sheet ID | S2 | S3 | S3 | S4 |
| Product Description | Low Strength 10.5" | High Strength 10.5" | High Strength 11.0" | High Strength Deb 10.5" |
| Basis Weight (lbs/ream) | 35.82 | 36.82 | 36.95 | 36.27 |
| Caliper (mils/8 sheets) | 238.1 | 235.7 | 233.1 | 234.2 |
| MD Tensile (g/3") | 2622 | 3511 | 3465 | 3129 |
| CD Tensile (g/3") | 2220 | 2881 | 2881 | 2340 |
| GM Tensile (g/3") | 2412 | 3180 | 3159 | 2705 |
| MD Stretch (%) | 21.8 | 22.8 | 23.0 | 21.0 |
| CD Stretch (%) | 9.1 | 9.0 | 8.9 | 8.8 |
| CD Wet Tensile - Finch (g/3") | 603 | 803 | 800 | 716 |
| CD Wet/Dry - Finch (%) | 30.8 | 29.2 | 30.7 | 29.2 |
| Perf Tensile (g/3") | 493 | 654 | 640 | 620 |
| SAT Capacity (g/sq meter) | 564 | 566 | 575 | 519 |
| SAT Capacity (g/g) | 9.7 | 9.4 | 9.6 | 8.8 |
| SAT Rate (g/sec^0.5) | 0.32 | 0.32 | 0.34 | 0.24 |
| GM Break Modulus (g/%) | 172.1 | 222.5 | 220.0 | 199.0 |
| GM Tensile Modulus (g/in/%) | 37.0 | 46.4 | 46.6 | 41.2 |
| Macbeth 3100 Brightness | 82.3 | 79.8 | 80.1 | 80.8 |
| Macbeth 3100 L* | 95.2 | 95.0 | 95.1 | 95.2 |
| Macbeth 3100 a* | −0.9 | −1.1 | −1.1 | −1.1 |
| Macbeth 3100 b* | 4.7 | 6.2 | 6.2 | 5.8 |
| Roll Diameter (inches) | 5.16 | 5.15 | 5.23 | 5.15 |
| Roll Compression (%) | 8.3 | 8.5 | 8.1 | 9.0 |
| Sheet Count | 56 | 56 | 56 | 56 |
| Sheet Length (inches) | 10.53 | 10.52 | 11.00 | 10.48 |
| Sheet Width (inches) | 11.05 | 11.03 | 11.06 | 11.03 |
| Sensory Softness | 7.36 | 6.60 | 6.66 | 7.08 |

Both SAT capacity and softness of W855.1 were unexpectedly high, while the absorbency and softness values of W856.1 and W856.2 were slightly higher than expected with wet strengths that were considerably higher than the expected wet strength of 650 g/3".

Prototype W857.1 made using the "S4" base sheet, having debonder added at the wet end, exhibited both reduced SAT capacity and rate but also showed an unexpectedly low wet/dry ratio, even though its base sheet wet/dry ratio (see Table 5-2 above) was substantially higher than that of the "S3" base sheet suggesting that use of debonder was in this instance counterproductive, even though small amounts can be tolerated.

One of the product prototypes, Cell W856.2, made using the S3 base sheet, was tested in a Paired HUT vs. "B" the current market leading brand which uses a premium fiber blend. The results show that the product of the invention is preferred to "B", despite its fiber disadvantage.

TABLE 5-5

| Physical Properties, Fiber Properties, and Paired HUT Results | Product | |
|---|---|---|
| | W856.1 | "B" |
| Basis Weight (lbs/ream) | 36.82 | 27.70 |
| Caliper (mils/8 sheets) | 235.7 | 192.7 |
| MD Tensile (g/3") | 3511 | 3045 |
| CD Tensile (g/3") | 2881 | 2122 |
| GM Tensile (g/3") | 3180 | 2540 |
| MD Stretch (%) | 22.8 | 16.2 |
| CD Stretch (%) | 9.0 | 14.1 |
| CD Wet Tensile - Finch (g/3") | 803 | 687 |
| CD Wet/Dry - Finch (%) | 29.2 | 32.4 |
| Perf Tensile (g/3") | 654 | 769 |
| SAT Capacity (g/m$^2$) | 566 | 565 |
| SAT Capacity (g/g) | 9.4 | 12.5 |
| SAT Rate (g/sec$^{0.5}$) | 0.32 | 0.18 |
| GM Break Modulus (g/%) | 222.5 | 172.3 |
| GM Tensile Modulus (g/in/%) | 46.4 | 43.9 |
| Roll Diameter (inches) | 5.15 | 4.89 |
| Roll Compression (%) | 8.5 | 10.4 |
| Sensory Softness | 6.60 | 7.91 |
| Fiber Properties | | |
| $L_n$ (mm) | 0.49 | 0.62 |
| $L_w$ (mm) | 1.66 | 1.41 |
| $L_z$ (mm) | 2.58 | 2.16 |
| Coarseness (mg/100 m) | 15.55 | 10.95 |
| $C/L_z$ (mg/100 m/mm) | 6.03 | 5.07 |
| Fines (num %) | 58.11 | 38.15 |
| Fines (wt %) | 10.53 | 4.83 |
| Paired HUT Results | | |
| Number of Respondents | 319 | — |
| Preferred Prototype (%) | 57 | — |
| No Preference (%) | 18 | — |
| Preferred "B" (%) | 26 | — |

Example 6

In the course of consumer testing of the product of the present invention, it was noticed that consumers perceived the softness of these towels as considerably softer than would have normally been predicted when subjected to softness evaluation by sensory panels. This example compares the consumer softness of the product of the invention vs. the consumer softness of other products having similar (±1) panel softness. The data in Table 6-1 show that the invention receives a higher consumer softness rating than would be expected from the panel softness rating. Until recognized, this surprising and unexpected effect greatly hampered efforts to produce the towels of the present invention.

TABLE 6-1

| Softness Ratings of Towel Products | | | | |
|---|---|---|---|---|
| Product | Basis Weight (lbs/ream) | Caliper (mils/8 sheets) | Panel Softness | Monadic HUT Softness (0-100) |
| Invention | 36.7 | 239.8 | 7.88 | 76 |
| A | 29.4 | 188.9 | 7.60 | 70 |
| W | 29.1 | 194.6 | 7.46 | 68 |
| C | 26.7 | 212.8 | 7.27 | 72 |
| D | 25.5 | 185.9 | 8.87 | 76 |
| E | 23.9 | 198.9 | 8.01 | 68 |
| F | 25.6 | 180.0 | 8.74 | 67 |

Example 7

This example compares a product of the invention to other commercially available products that have approximately the same strength. Even though the competitive products have better fiber (lower $C/L_z$), the product of the invention has equal or higher softness.

TABLE 7-1

| Properties of Towel Products | | | |
|---|---|---|---|
| Product | Current Invention | Competitive Product X | Competitive Product Y |
| Basis Weight (lbs/ream) | 36.82 | 28.77 | 25.8 |
| Caliper (mils/8 sheets) | 235.7 | 163.4 | 163.3 |
| MD Tensile (g/3") | 3511 | 4059 | 3439 |
| CD Tensile (g/3") | 2881 | 2279 | 2524 |
| GM Tensile (g/3") | 3180 | 3039 | 2945 |
| MD Stretch (%) | 22.8 | 13.5 | 14.2 |
| CD Stretch (%) | 9.0 | 8.0 | 9.6 |
| CD Wet Tensile - Finch (g/3") | 803 | 532 | 553 |
| CD Wet/Dry - Finch (%) | 29.2 | 23.4 | 21.9 |
| Perf Tensile (g/3") | 654 | 766 | 872 |
| SAT Capacity (g/m$^2$) | 566 | 382 | 339 |
| SAT Capacity (g/g) | 9.4 | 8.2 | 8.1 |
| SAT Rate (g/sec$^{0.5}$) | 0.32 | 0.18 | 0.17 |
| GM Break Modulus (g/%) | 222.5 | 292.5 | 251 |
| GM Tensile Modulus (g/in/%) | 46.4 | 50.0 | 51 |
| Roll Diameter (inches) | 5.15 | 5.05 | 5.0 |
| Roll Compression (%) | 8.5 | 19.2 | 26.0 |
| Sensory Softness | 6.60 | 6.43 | 5.10 |
| $L_n$ (mm) | 0.49 | 0.65 | 0.55 |
| $L_w$ (mm) | 1.66 | 2.19 | 1.82 |
| $L_z$ (mm) | 2.58 | 2.82 | 2.63 |
| Coarseness (mg/100 m) | 15.55 | 13.97 | 13.05 |
| $C/L_z$ (mg/100 m/mm) | 6.03 | 4.95 | 4.96 |
| Fines (num %) | 58.11 | 61.11 | 58.54 |
| Fines (wt %) | 10.53 | 7.31 | 9.08 |

Example 8

Two base sheets were produced in a similar manner to that described in Example 2 from a furnish made up of 70% SWK, 30% HWK that included 30% Broke. For one of the base sheets, the layer next to the Yankee dryer contained 100% SWK; the other base sheet had a Yankee-side layer composed of a 50/50 blend of SWK and HWK. The base sheet physical properties are shown in Table 8-1.

TABLE 8-1

| Base Sheet Physical Properties | | |
|---|---|---|
| Yankee Layer Stratification | 100% SWK | 50/50 SWK/HWK |
| Basis Weight (lbs/ream) | 19.61 | 19.44 |
| Caliper (mils/8 sheets) | 115.5 | 111.1 |
| MD Tensile (g/3") | 1567 | 1699 |
| CD Tensile (g/3") | 1526 | 1714 |
| GM Tensile (g/3") | 1544 | 1707 |
| Tensile Ratio | 1.03 | 0.99 |
| MD Stretch (%) | 21.4 | 23.0 |
| CD Stretch (%) | 7.5 | 7.6 |
| CD Wet Tensile - Finch (g/3") | 436 | 508 |
| CD Wet/Dry - Finch (%) | 28.6 | 29.7 |
| SAT Capacity (g/sq meter) | 647 | 632 |
| SAT Capacity (g^0.5) | 0.35 | 0.31 |
| GM Break Modulus (g/%) | 123.7 | 130.4 |
| GM Tensile Modulus (g/in/%) | 38.9 | 36.4 |

Fiber counts of both base sheets were performed to determine the actual fiber stratification of the towels. Table 8-2 shows the results of these counts, both of a composite sample and of the individual layers. The test results show that, though the overall fiber composition of the two sheets is quite similar, the distribution of the fibers within the sheet is very different, with the base sheet having all SWK placed in the Yankee layer having a much higher percentage of that fiber in Layer 1, the Yankee-side layer.

TABLE 8-2

Fiber Analysis of Towel Base Sheets

| Yankee Layer Stratification | 100% SWK | 50/50 SWK/HWK |
|---|---|---|
| Fiber Composition (% SWK/% HWK) | 57.9/42.1 | 56.9/43.1 |
| Total Sheet | | |
| Layer 1 (Yankee Layer) | 86.0/14.0 | 51.1/48.9 |
| Layer 3 | 80.3/19.7 | 53.0/47.0 |
| Layer 6 | 44.8/55.2 | 47.4/52.6 |
| Layer 8 | 27.3/72.7 | 63.7/36.3 |

Both base sheets were converted to two-ply finished product using the emboss pattern shown in FIGS. 3A and 3B. The products were produced such that the Yankee layers of the base sheet were on the outside of the towel product. The embossing conditions used to produce the towels are shown in Table 8-3

TABLE 8-3

Embossing Conditions

| | Value |
|---|---|
| Emboss Parameter | |
| Upper Rubber Roll Diameter | 19.5 inches (0.625" thick rubber covering) |
| Upper Steel Emboss Roll Diameter | 20 inches |
| Upper Rubber Roll Hardness | 45 Shore A (Dual Durometer) |
| Upper Embosser Nip Width | 1-13/16 inch |
| Lower Rubber Roll Diameter | 19.5 inches (0.625" thick rubber covering) |
| Lower Steel Emboss Roll Diameter | 20 inches |
| Lower Rubber Roll Hardness | 45 Shore A (Dual Durometer) |
| Lower Embosser Nip Width | 1-13/16 inch |
| Marrying Roll Diameter | 14 inches |
| Marrying Roll Rubber Hardness | 90 Shore A (spec) |
| Marrying Roll Nip Width | 5/8 inch |
| Draw Roll Gaps - Infeed/Outfeed | 0.035/0.035 inch |
| Rewinder Parameters | |
| #1 Unwind Tension | 14 lbs |
| #2 Unwind Tension | 14 lbs |
| Rewinder Tension | 4 lbs |
| Enveloping Roll | −0.90 draw |
| Perforator | −0.92 draw |
| Speed | 777 fpm |

The physical properties of the two towel prototypes are shown in the Table 8-4 below.

TABLE 8-4

Product Physical Properties

| Yankee Layer Stratification | 100% SWK | 50/50 SWK/HWK |
|---|---|---|
| Basis Weight (lbs/ream) | 37.11 | 36.40 |
| Caliper (mils/8 sheets) | 228.7 | 227.1 |
| MD Tensile (g/3") | 2680 | 2825 |
| CD Tensile (g/3") | 2047 | 2297 |
| GM Tensile (g/3") | 2341 | 2546 |
| Tensile Ratio | 1.31 | 1.23 |
| MD Stretch (%) | 18.6 | 16.7 |

TABLE 8-4-continued

Product Physical Properties

| Yankee Layer Stratification | 100% SWK | 50/50 SWK/HWK |
|---|---|---|
| CD Stretch (%) | 8.0 | 8.2 |
| CD Wet Tensile - Finch (g/3") | 609 | 638 |
| CD Wet/Dry - Finch (%) | 29.8 | 27.8 |
| Perf Tensile (g/3") | 936 | 1068 |
| SAT Capacity (g/sq meter) | 545 | 520 |
| SAT Capacity (g/g) | 9.02 | 8.78 |
| SAT Rate (g/sec^0.5) | 0.25 | 0.23 |
| GM Break Modulus (g/%) | 192.0 | 216.5 |
| GM Tensile Modulus (g/in/%) | 40.8 | 49.0 |
| Roll Diameter (inches) | 4.90 | 4.93 |
| Roll Compression (%) | 8.6 | 9.0 |
| Sensory Softness | 7.83 | 7.46 |

Both prototypes had similar physical properties and good softness values. However, finished products made from the base sheet having the 50/50 SWK/HWK blend in the Yankee-side layer produced more dust and lint during the converting process than did the prototype made using the base sheet whose Yankee layer was composed of 100% SWK. This dust required cleaning at intervals to remove dust from the converting lines. Base sheet made using the sheet having 100% SWK in the Yankee layer was converted without these issues.

Example 9

A towel base sheet was produced on a TAD paper machine in a manner similar to that described in Example 2. The overall furnish was composed of a 70/30 blend of SWK/HWK and included 30% broke. The physical properties of the base sheet are shown in Table 9-1.

TABLE 9-1

Base Sheet Physical Properties

| | |
|---|---|
| Basis Weight (lbs/ream) | 19.73 |
| Caliper (mils/8 sheets) | 114.2 |
| MD Tensile (g/3") | 1602 |
| CD Tensile (g/3") | 1694 |
| GM Tensile (g/3") | 1645 |
| Tensile Ratio | 0.95 |
| MD Stretch (%) | 23.3 |
| CD Stretch (%) | 6.6 |
| CD Wet Tensile - Finch (g/3") | 441 |
| CD Wet/Dry - Finch (%) | 26.0 |
| SAT Capacity (g/sq meter) | 603 |
| SAT Capacity (g/g) | 9.40 |
| SAT Rate (g/sec^0.5) | 0.26 |
| GM Break Modulus (g/%) | 134.1 |
| GM Tensile Modulus (g/in/%) | 35.3 |

The base sheet was embossed using the emboss pattern shown in FIGS. 3A and 3B. Finished products were produced at four levels of emboss, as shown in Table 9-2.

TABLE 9-2

Emboss Nip Widths - Penetration Curve Samples

| Marrying Roll (all cells) | 5/8 inch |
|---|---|
| Condition 1A | |
| Upper Embosser | 1-13/16 inch |
| Lower Embosser | 1-13/16 inch |

TABLE 9-2-continued

| Emboss Nip Widths - Penetration Curve Samples | |
|---|---|
| Marrying Roll (all cells) | 5/8 inch |
| Condition 1B | |
| Upper Embosser | 1-15/16 inch |
| Lower Embosser | 1-15/16 inch |
| Condition 1C | |
| Upper Embosser | 1-5/8 inch |
| Lower Embosser | 1-3/4 inch |
| Condition 1D | |
| Upper Embosser | 1-1/2 inch |
| Lower Embosser | 1-11/16 inch |

The physical properties of the finished products produced are shown in Table 9-3.

TABLE 9-3

| Penetration Curve Samples | | | | |
|---|---|---|---|---|
| Product | Cell 1A | Cell 1B | Cell 1C | Cell 1D |
| Basis Weight (lbs/ream) | 36.83 | 36.95 | 37.33 | 37.69 |
| Caliper (mils/8 sheets) | 225.5 | 229.2 | 212.3 | 209.8 |
| MD Tensile (g/3") | 3183 | 2908 | 3374 | 3433 |
| CD Tensile (g/3") | 2389 | 2121 | 2824 | 3003 |
| GM Tensile (g/3") | 2757 | 2483 | 3084 | 3210 |
| Tensile Ratio | 1.33 | 1.37 | 1.19 | 1.14 |
| MD Stretch (%) | 16.1 | 15.8 | 17.5 | 18.4 |
| CD Stretch (%) | 8.0 | 8.3 | 7.6 | 7.7 |
| CD Wet Tensile - Finch (g/3") | 658 | 594 | 810 | 834 |
| CD Wet/Dry - Finch (%) | 27.5 | 28.0 | 28.7 | 27.8 |
| Perf Tensile (g/3") | 1044 | 1185 | 824 | 1264 |
| SAT Capacity (g/sq meter) | 508 | 526 | 514 | 518 |
| SAT Capacity (g/g) | 8.47 | 8.75 | 8.45 | 8.44 |
| SAT Rate (g/sec^0.5) | 0.22 | 0.22 | 0.21 | 0.22 |
| GM Break Modulus (g/%) | 242.3 | 215.2 | 266.5 | 266.9 |
| GM Tensile Modulus (g/in/%) | 50.6 | 46.1 | 56.5 | 54.3 |
| Roll Diameter (inches) | 4.94 | 4.93 | 4.89 | 4.90 |
| Roll Compression (%) | 9.8 | 7.9 | 12.9 | 13.3 |
| Sensory Softness | 7.36 | 7.48 | 7.00 | 6.75 |

Figure 7:
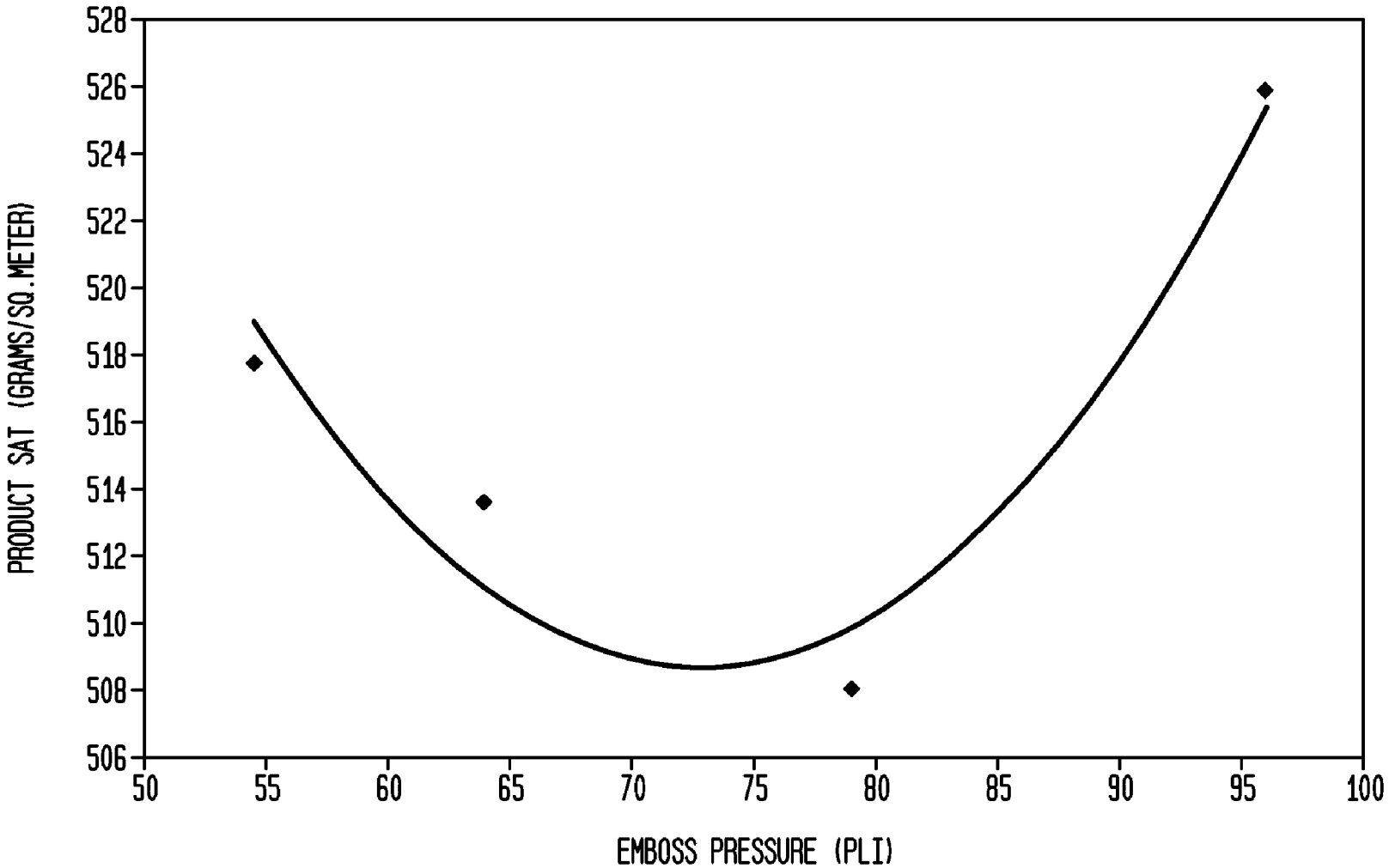
Figure 8:
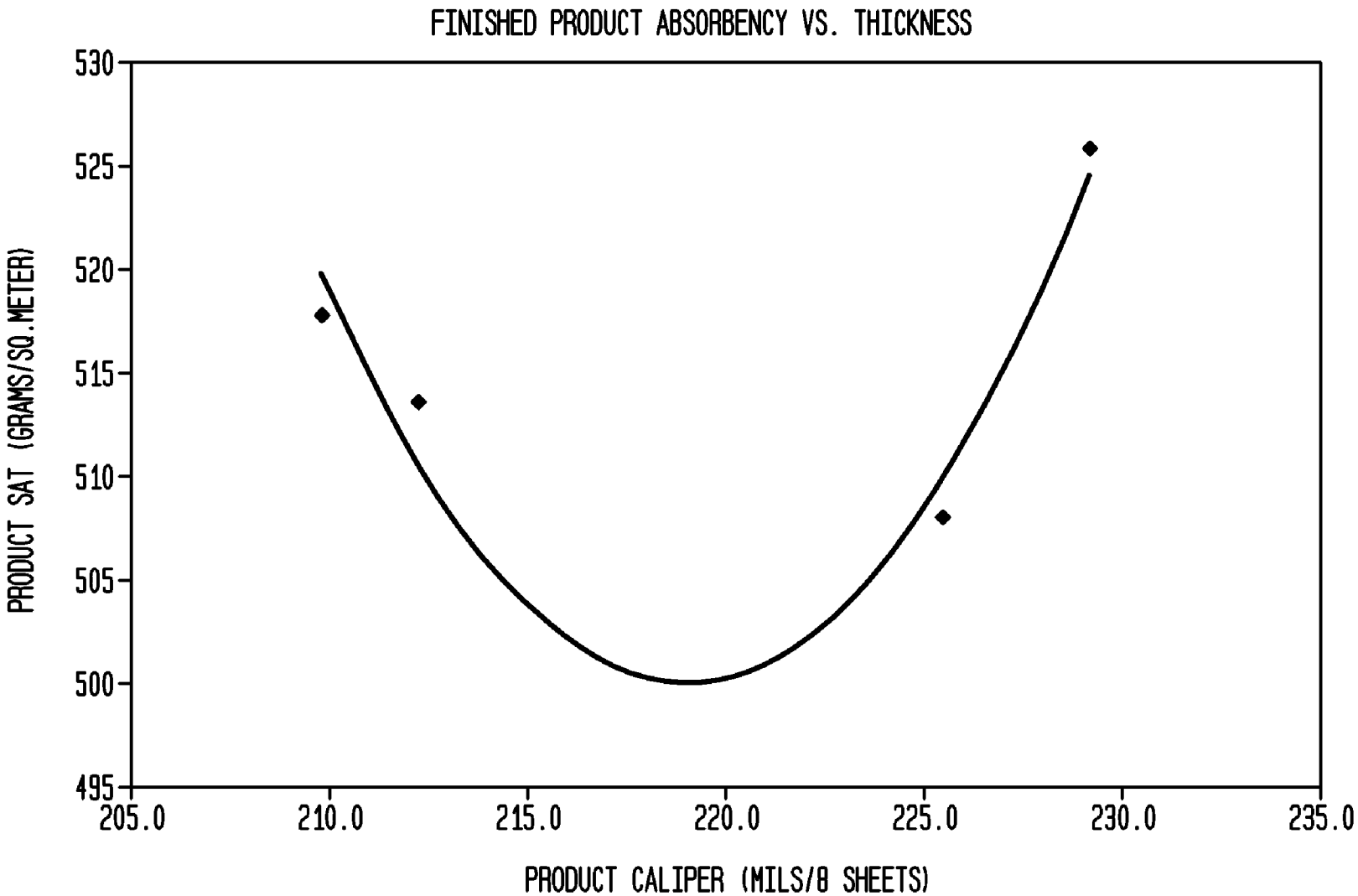

Examination of the finished product data shows that, as expected, the caliper of the product increased with increasing emboss penetration. This finding is illustrated in FIG. 6. In the figure, the emboss penetration values have been translated to an embossing pressure, expressing in pounds/lineal inch (PLI). Surprisingly, however, the towel's absorption capacity (as measured by the simple absorption test—SAT) declined with increasing emboss penetration until a certain level of emboss was reached, at which point the absorption capacity of the product increased. This finding is illustrated in FIG. 7. FIG. 8 combines the results of FIGS. 6 and 7, illustrating the surprising relationship between absorbency and caliper.

As our invention, we claim:

1. A method of forming a multi-ply cellulosic web comprising:

a) supplying to a headbox an aqueous stream comprising:
   i) a short cellulosic fiber having an average weight-weighted fiber length of at most 1.9 mm; and
   ii) a long cellulosic fiber having:
      (1) a average weight-weighted fiber length of at least 2.5 mm; and
      (2) a coarseness at least 15.5 mg/100 mm b) with the weight ratio of short fiber to long fiber being at least 0.25 to 1.0 with the short fiber component having a Canadian Standard freeness of at least 500 ml and the long fiber component having a Canadian Standard freeness of at least 600 ml;

c) forming the web on a first moving foraminous fabric;

d) non-compactively dewatering the web deposited on the first moving foraminous fabric to form a nascent web having a consistency in the range from about 10% to about 35%;

e) transferring the nascent web from the first moving foraminous fabric to a second moving foraminous fabric where the first moving foraminous fabric travels at a speed higher than the second moving foraminous fabric so that the fabric crepe level of the nascent web after transfer is at least about 15%;

f) drying the nascent web on the second moving foraminous fabric to at most 95% solids;

g) transferring the web to a cylinder dryer to further dry the web to at most 98.5% solids;

h) creping the web from the cylinder dryer;

i) transferring the nascent web from the cylinder dryer to a reel where the cylinder dryer is operating at a speed such that the reel crepe is at most 3%;

j) converting the nascent web to form a two-ply product having basis weight of at least 32 lb/rm and caliper of at least 220 mils/8 sheets.

2. The method of claim 1 wherein the $C/l_2$ of the furnish is at least about 5.3.

3. The method of claim 1 wherein the amount of softener applied, if any, is controlled to such a level that the SAT absorbency of the product exceeds about 8.5 g/g.

4. The method of claim 1 wherein the amount of softener applied, if any, is controlled to such a level that the SAT absorbency of the product exceeds about 9.0 g/g.

5. The method of claim 1 wherein the amount of softener applied, if any, is controlled to such a level that the SAT absorbency of the product exceeds about 9.5 g/g.

6. The method of claim 1 wherein the average weight-weighted fiber length of the long cellulosic fiber is at least 2.7 mm.

7. The method of claim 1 wherein the average weight-weighted fiber length of the long cellulosic fiber is at least 2.9 mm.

8. The method of claim 1 wherein the average weight-weighted fiber length of the long cellulosic fiber is at least 3.1 mm.

9. The method of claim 1 wherein the weight ratio of short fiber to long fiber is at least 0.5 to 1.

10. The method of claim 1 wherein the weight ratio of short fiber to long fiber is at least 0.67 to 1.

11. The method of claim 1 wherein the amount of softener applied, if any, is controlled to such a level that the SAT absorbency of the product exceeds about 9.0 g/g.

12. The multi-ply cellulosic web formed by the process of claim 1 wherein the amount of softener applied, if any, is controlled to such a level that the SAT absorbency of the base sheet exceeds about 10.0 g/g.

13. The multi-ply cellulosic web formed by the process of claim 1 wherein the sheet is creped from the drying cylinder at a consistency of at least about 96%.

14. The multi-ply cellulosic web formed by the process of claim 1 wherein the sheet is creped from the drying cylinder at a consistency of at least about 97%.

15. The multi-ply cellulosic web formed by the process of claim 1 wherein the sheet exhibits a finished product caliper of at least 6.2 mils/8 sheets per lb/rm of basis weight.

16. The multi-ply cellulosic web formed by the process of claim 1 wherein the sheet exhibits a basis weight of at least about 35 lbs/rm; a caliper of at least about 235 mils/8 sheets; a GM tensile strength of no more than 2800 g/3"; an MD stretch of at least about 18%; a CD wet tensile (Finch cup method) of at least about 550 g/3"; a SAT capacity of at least about 9.0 and a GM tensile modulus of no more than about 45 g/in/%.

17. A method of forming a cellulosic web comprising:

a) supplying to a headbox an aqueous stream comprising:
   i) a cellulosic short fiber having an average weight-weight fiber length of at most 1.9 mm; and
   ii) a cellulosic long fiber having:
      (1) an average weight-weight fiber length of at least 2.7 mm; and
      (2) a coarseness at least 15.5 mg/100 mm b) with the weight ratio of short fiber to long fiber being at least 0.4 to 1.0 with the short fiber component having a Canadian Standard freeness of at least 500 ml and the long fiber component having a Canadian Standard freeness of at least 600 ml;

c) forming the web on a first moving foraminous fabric;

d) non-compactively dewatering the web deposited on the first moving foraminous fabric to a consistency in the range from about 10% to about 35%;

e) transferring the nascent web from the first moving foraminous fabric to a second moving foraminous fabric where the first moving foraminous fabric travels at a speed higher than the second moving foraminous fabric so that the fabric crepe level of the nascent web after transfer is at least about 18%;

f) drying the nascent web on the second moving foraminous fabric to at most 95% solids;

g) transferring the web to a cylinder dryer to further dry the web to at most 98.5% solids;

h) dry creping the web from the cylinder dryer;

i) transferring the nascent web from the cylinder dryer to a reel where the cylinder dryer is operating at a speed such that the reel crepe is at most 3%; and j) converting the nascent web to form a two-ply product having basis weight of at least 32 lb/rm and caliper of at least 220 mils/8 sheets wherein the furnish, fabric creping parameters, dry creping parameters and wet strength resin are controlled such that the base sheet recovered has a conditioned basis weight of at least about 19 lbs/3000 sq ft ream, a tensile ratio of between about 0.9 and 1.1, a CD wet tensile of at least 450 g/3", a GM dry tensile of no more than about 1900 g/3", and a GM break modulus of no more than 170 g/%.

18. The method of claim 17 wherein the $C/l_z$ of the furnish is at least about 5.3.

19. The method of claim 17 wherein the amount of softener applied, if any, is controlled to such a level that the SAT absorbency of the basesheet exceeds about 10.0 g/g.

20. The method of claim 17 wherein the amount of softener applied, if any, is controlled to such a level that the SAT absorbency of the basesheet exceeds about 10.5 g/g.

21. The method of claim 17 wherein the amount of softener applied, if any, is controlled to such a level that the SAT absorbency of the basesheet exceeds about 10.7 g/g.

22. The method of claim 17 wherein the sheet is creped from the drying cylinder at a consistency of at least about 96%.

23. The method of claim 17 wherein the sheet is creped from the drying cylinder at a consistency of at least about 97%.

24. The method of claim 17 wherein the finished product exhibits a conditioned basis weight of at least about 35 lbs/rm; a caliper of at least about 235 mils/8 sheets; an MD tensile of no more than 2800 g/3"; an MD stretch of at least about 20%; a CD wet tensile (Finch cup method) of at least about 550 g/3"; a SAT capacity of at least about 9.5 and a GM tensile modulus of no more than about 40 g/in/%.

25. A two-ply towel product having basis weight of at least 32 lb/rm, a geometric dry tensile strength of at most 2500 g/3", a thickness of at least 220 mils/8 sheets, said two-ply towel product being made by the process comprising:

a) supplying to a headbox an aqueous stream comprising:
   i) a high freeness short fiber having an average weight-weight fiber length of at most 1.9 mm; and
   ii) a high freeness long fiber having an average weight-weight fiber length of at least 2.7 mm and having a coarseness at least 15.5 mg/100 mm with the ratio of short fiber to long fiber being at least 0.25 to 1.0 with the short fiber component having a Canadian Standard freeness of at least 500 ml and the long fiber component having a Canadian Standard freeness of at least 600 ml;

b) forming the web on a first foraminous forming fabric;

c) non-compactively dewatering the web deposited on the first moving foraminous fabric to a consistency in the range from about 10% to about 35%;

d) transferring the nascent web from the first foraminous endless forming fabric to a second moving foraminous fabric where the first moving foraminous fabric is operating at a speed higher than the second moving foraminous fabric so that the fabric crepe level is at least about 18%;

e) drying the nascent web on the second moving foraminous fabric to at most 95% solids;

f) transferring the web to a cylinder dryer to further dry the web to at most 98.5% solids;

g) creping the web from the cylinder dryer;

h) transferring the nascent web from the cylinder dryer to a reel where the cylinder dryer is operating at a speed such that the reel crepe is at most 3%;

i) converting the nascent web to form a two-ply product.

26. The two-ply towel product of claim 25 wherein the $C/l_z$ of the furnish is at least about 5.3.

27. The two-ply towel product of claim 25 wherein the amount of softener applied, if any, is controlled to such a level that the SAT absorbency of the product exceeds about 9.0 g/g.

28. The two-ply towel product of claim 25 wherein the amount of softener applied, if any, is controlled to such a level that the SAT absorbency of the product exceeds about 9.5 g/g.

29. The two-ply towel product of claim 25 wherein the amount of softener applied, if any, is controlled to such a level that the SAT absorbency of the product exceeds about 10.0 g/g.

30. The two-ply towel product of claim 25 wherein the amount of softener applied, if any, is controlled to such a level that the SAT absorbency of the base sheet exceeds about 10.5 g/g.

31. The two-ply towel product of claim 25 wherein the sheet is creped from the drying cylinder at a consistency of at least about 96%.

32. The two-ply towel product of claim 25 wherein the sheet is creped from the drying cylinder at a consistency of at least about 97%.

33. The two-ply towel product of claim 25 wherein the sheet exhibits a finished product caliper of at least 6.2 mils/8 sheets per lb/rm of basis weight.

34. The two-ply towel product of claim 25 wherein the finished product exhibits a basis weight of at least about 35 lbs/rm; a caliper of at least about 235 mils/8 sheets; a GM tensile strength of no more than 2800 g/3"; an MD stretch of at least about 20%; a CD wet tensile (Finch cup method) of at least about 550 g/3"; a SAT capacity of at least about 9.5 and a GM tensile modulus of no more than about 40 g/in/%.

35. A two-ply TAD towel comprising between about 50 to 75 wt. % softwood Kraft fibers having a average weight-weight fiber length of at least 2.7 mm; and a coarseness at least 20 mg/100 mm and a Canadian Standard freeness of at least 600 ml, and between about 25 and 50 wt. % short fibers having an average weight-weighted fiber length of at most 1.9 mm and a Canadian Standard freeness of at least 500 ml; and comprising between about 9 and 20 lbs of PAE wet strength resin per ton, and between 2 and 7 lbs of carboxymethyl cellulose per ton, said towel exhibiting:

a) a basis weight of between 34 and 38 lbs/3000 sq ft ream;
b) a geometric mean dry tensile strength of 2000 and 3300 g/3";
c) a specific geometric mean dry tensile strength of 60 and 85 g/3" per lb/rm of basis weight;
d) a caliper of between about 220 and 250 mils per 8 sheets,
e) a specific caliper of between about 6.5 and 7.5 mils per 8 sheets per lb/rm of basis weight;
f) a gross SAT capacity of between about 450 and 650 g/m$^2$;
g) a specific SAT capacity of between about 13 and 17 g/m$^2$ per lb of basis weight;
h) a CD wet tensile strength of between 475 and 825 g/3";
i) a specific CD wet tensile strength of between 15 and 22 g/3" per lb of basis weight;
j) a geometric break modulus of between 175 and 225 g/% stretch; and
k) a specific break modulus of between 5.0 and 6.0 g/% stretch per lb/rm of basis weight.

36. A two-ply TAD towel comprising between about 50 to 75 wt. % softwood Kraft fibers having an average weighted-weighted fiber length of at least 2.7 mm; and a coarseness at least 15.5 mg/100 mm and a Canadian Standard freeness of at least 600 ml, and between about 25 to 50 wt. % short fibers having an average weight-weighted fiber length of at most 1.9 mm and a Canadian Standard freeness of at least 500 ml; and comprising between about 9 and 20 lbs of wet strength resin per ton, and between 2 and 7 lbs per ton of carboxymethyl cellulose, said towel exhibiting:

a) a basis weight of between 34 and 38 lbs/3000 sq ft ream;
b) a geometric mean dry tensile strength of no more than 2700 g/3";
c) a specific geometric mean dry tensile strength of between no more than 80 g/3" per lb/rm of basis weight;
d) a caliper of at least about 220 mils per 8 sheets,
e) a specific caliper of at least about 6.5 mils per 8 sheets per lb/rm of basis weight;
f) a gross SAT capacity of at least 500 g/m$^2$;
g) a specific SAT capacity of at least about 14 g/m$^2$ per lb/rm of basis weight;
h) a CD wet tensile strength of at least about 600 but no more than about 700 g/3";
i) a specific CD wet tensile strength of between 15 and 20 g/3" per lb of basis weight; and
j) an MD stretch of least about 20%.

37. A method of forming a two-ply cellulosic web comprising:

a) supplying to a first layer of a stratified headbox an aqueous stream comprising:
  i) a long cellulosic fiber having:
    (1) a average weight-weighted fiber length of at least 2.7 mm; and
    (2) a coarseness at least 15.5 mg/100 mm; and
  ii) a short cellulosic fiber having an average weight-weighted fiber length of at most 1.9 mm;

with the short fiber component having a Canadian Standard freeness of at least 500 ml and the long fiber component having a Canadian Standard freeness of at least 600 ml, with the weight ratio of long fiber to short fiber being from at least 0.25 to 1.0 up to about 0.67 to 1.0;

b) supplying to an second layer of a stratified headbox an aqueous stream comprising:
  i) a short cellulosic fiber having an average weight-weighted fiber length of at most 1.9 mm; and
  ii) a long cellulosic fiber having:
    (1) a average weight-weighted fiber length of at least 2.7 mm; and
    (2) a coarseness at least 15.5 mg/100 mm with the weight ratio of short fiber to long fiber being at least 0.4 to 1.0 with the short fiber component having a Canadian Standard freeness of at least 500 ml and the long fiber component having a Canadian Standard freeness of at least 600 ml;

c) forming the web on a first moving foraminous fabric;
d) non-compactively dewatering the web deposited on the first moving foraminous fabric to form a nascent web having a consistency in the range from about 10% to about 35%;
e) transferring the nascent web from the first moving foraminous fabric to a second moving foraminous fabric where the first moving foraminous fabric travels at a speed higher than the second moving foraminous fabric so that the fabric crepe level of the nascent web after transfer is at least about 18%;
f) drying the nascent web on the second moving foraminous fabric to at most 95% solids;
g) transferring the web to a cylinder dryer to further dry the web to at most 98.5% solids;
h) creping the web from the cylinder dryer;
i) transferring the nascent web from the cylinder dryer to a reel where the cylinder dryer is operating at a speed such that the reel crepe is at most 3%;
j) converting the nascent web to form a two-ply product having a basis weight of at least 32 lb/rm and caliper of at least 220 mils/8 sheets with the surface of the product corresponding to the first layer of said stratified headbox being disposed to the exterior of said two-ply product.

38. The two-ply cellulosic web formed by the process of claim 37 wherein the content of long fiber in said first layer is at least about 70% by weight.

39. The two-ply cellulosic web formed by the process of claim 37 wherein the ratio of long fiber in said first layer is at least about 80% by weight.

40. The two-ply cellulosic web formed by the process of claim 37 wherein the $C/l_z$ of the furnish is at least about 5.3.

41. The two-ply cellulosic web formed by the process of claim 37 wherein the amount of softener applied, if any, is controlled to such a level that the SAT absorbency of the product exceeds about 9.0 g/g.

42. The two-ply cellulosic web formed by the process of claim 37 wherein the amount of softener applied, if any, is controlled to such a level that the SAT absorbency of the product exceeds about 9.5 g/g.

43. The two-ply cellulosic web formed by the process of claim 37 wherein the amount of softener applied, if any, is controlled to such a level that the SAT absorbency of the product exceeds about 10.0 g/g.

44. The two-ply cellulosic web formed by the process of claim 37 wherein the amount of softener applied, if any, is controlled to such a level that the SAT absorbency of the base sheet exceeds about 10.5 g/g.

45. The two-ply cellulosic web formed by the process of claim 37 wherein the sheet is creped from the drying cylinder at a consistency of at least about 96%.

46. The two-ply cellulosic web formed by the process of claim 37 wherein the sheet is creped from the drying cylinder at a consistency of at least about 97%.

47. The two-ply cellulosic web formed by the process of claim 37 wherein the sheet exhibits a finished product caliper of at least 6.2 mils/8 sheets per lb/rm of basis weight.

48. The two-ply cellulosic web formed by the process of claim 37 wherein the sheet exhibits a basis weight of at least about 35 lbs/rm; a caliper of at least about 235 mils/8 sheets; a GM tensile strength of no more than 2800 g/3"; an MD stretch of at least about 20%; a CD wet tensile (Finch cup method) of at least about 550 g/3"; a SAT capacity of at least about 9.5 and a GM tensile modulus of no more than about 40 g/in/%.

49. A method of forming a multi-ply cellulosic web comprising:

a) supplying to a headbox an aqueous stream comprising:
   i) a short cellulosic fiber having an average weight-weighted fiber length of at most 1.9 mm; and
   ii) a long cellulosic fiber having:
      (1) a average weight-weighted fiber length of at least 2.5 mm; and
      (2) a coarseness at least 15.5 mg/100 mm
b) with the weight ratio of short fiber to long fiber being at least 0.25 to 1.0 with the short fiber component having a Canadian Standard freeness of at least 500 ml and the long fiber component having a Canadian Standard freeness of at least 600 ml;
c) forming the web on a first moving foraminous fabric;
d) non-compactively dewatering the web deposited on the first moving foraminous fabric to form a nascent web having a consistency in the range from about 10% to about 35%;
e) transferring the nascent web from the first moving foraminous fabric to a second moving foraminous fabric where the first moving foraminous fabric travels at a speed higher than the second moving foraminous fabric so that the fabric crepe level of the nascent web after transfer is at least about 15%;
f) drying the nascent web on the second moving foraminous fabric to at most 95% solids;
g) transferring the web to a cylinder dryer to further dry the web to at most 98.5% solids;
h) creping the web from the cylinder dryer;
i) transferring the nascent web from the cylinder dryer to a reel where the cylinder dryer is operating at a speed such that the reel crepe is at most 3%;
j) converting the nascent web to form a two-ply product having basis weight of at least 29 lb/rm and caliper of at least 220 mils/8 sheets.

50. The method of claim 49 wherein the $C/l_z$ of the furnish is at least about 5.3.

51. The method of claim 49 wherein the amount of softener applied, if any, is controlled to such a level that the SAT absorbency of the product exceeds about 8.5 g/g.

52. The method of claim 49 wherein the amount of softener applied, if any, is controlled to such a level that the SAT absorbency of the product exceeds about 9.0 g/g.

53. The method of claim 49 wherein the amount of softener applied, if any, is controlled to such a level that the SAT absorbency of the product exceeds about 9.5 g/g.

54. The method of claim 49 wherein the average weight-weighted fiber length of the long cellulosic fiber is at least 2.7 mm.

55. The method of claim 49 wherein the average weight-weighted fiber length of the long cellulosic fiber is at least 2.9 mm.

56. The method of claim 49 wherein the average weight-weighted fiber length of the long cellulosic fiber is at least 3.1 mm.

57. The method of claim 49 wherein the weight ratio of short fiber to long fiber is at least 0.5 to 1.

58. The method of claim 49 wherein the weight ratio of short fiber to long fiber is at least 0.67 to 1.

59. The method of claim 49 wherein the amount of softener applied, if any, is controlled to such a level that the SAT absorbency of the product exceeds about 9.0 g/g.

60. The multi-ply cellulosic web formed by the process of claim 49 wherein the amount of softener applied, if any, is controlled to such a level that the SAT absorbency of the base sheet exceeds about 10.0 g/g.

61. The multi-ply cellulosic web formed by the process of claim 49 wherein the sheet is creped from the drying cylinder at a consistency of at least about 96%.

62. The multi-ply cellulosic web formed by the process of claim 49 wherein the sheet is creped from the drying cylinder at a consistency of at least about 97%.

63. The multi-ply cellulosic web formed by the process of claim 49 wherein the sheet exhibits a finished product caliper of at least 6.2 mils/8 sheets per lb/rm of basis weight.

64. The multi-ply cellulosic web formed by the process of claim 49 wherein the sheet exhibits a basis weight of at least about 35 lbs/rm; a caliper of at least about 235 mils/8 sheets; a GM tensile strength of no more than 2800 g/3"; an MD stretch of at least about 18%; a CD wet tensile (Finch cup method) of at least about 550 g/3"; a SAT capacity of at least about 9.0 and a GM tensile modulus of no more than about 45 g/in/%.

65. A two-ply TAD towel comprising between about 50 to 75 wt. % softwood Kraft fibers having a average weight-weight fiber length of at least 2.7 mm; and a coarseness at least 20 mg/100 mm and a Canadian Standard freeness of at least 600 ml, and between about 25 and 50 wt. % short fibers having an average weight-weighted fiber length of at most 1.9 mm and a Canadian Standard freeness of at least 500 ml; and comprising between about 9 and 20 lbs of PAE wet strength resin per ton, and between 2 and 7 lbs of carboxymethyl cellulose per ton, said towel exhibiting:

a) a basis weight of between 29 and 38 lbs/3000 sq ft ream;
b) a geometric mean dry tensile strength of 2000 and 3300 g/3";
c) a specific geometric mean dry tensile strength of 60 and 85 g/3" per lb/rm of basis weight;
d) a caliper of between about 220 and 250 mils per 8 sheets,
e) a specific caliper of between about 6.5 and 7.5 mils per 8 sheets per lb/rm of basis weight;
f) a gross SAT capacity of between about 450 and 650 $g/m^2$;
g) a specific SAT capacity of between about 13 and 17 $g/m^2$ per lb/rm of basis weight;
h) a CD wet tensile strength of between 475 and 825 g/3";
i) a specific CD wet tensile strength of between 15 and 22 g/3" per lb/rm of basis weight;
j) a geometric break modulus of between 175 and 225 g/% stretch; and
k) a specific break modulus of between 5.0 and 6.0 g/% stretch per lb/rm of basis weight.

* * * * *